US005583963A

United States Patent [19]

Lozach

[11] Patent Number: 5,583,963

[45] Date of Patent: Dec. 10, 1996

[54] SYSTEM FOR PREDICTIVE CODING/DECODING OF A DIGITAL SPEECH SIGNAL BY EMBEDDED-CODE ADAPTIVE TRANSFORM

[75] Inventor: Bruno Lozach, Trebeurden, France

[73] Assignee: France Telecom, Paris, France

[21] Appl. No.: 184,186

[22] Filed: Jan. 21, 1994

[30] Foreign Application Priority Data

Jan. 21, 1993 [FR] France ..... 93 00601

[51] Int. Cl.[6] ..... G10L 3/02

[52] U.S. Cl. ..... 395/2.28; 395/2.32

[58] Field of Search ..... 395/2.28, 2.32; 370/111; 381/36

[56] References Cited

U.S. PATENT DOCUMENTS

| | | | |
|---|---|---|---|
| 5,146,457 | 9/1992 | Veldhuis et al. | 370/111 |
| 5,208,862 | 5/1993 | Ozawa | 381/36 |
| 5,353,373 | 10/1994 | Drogo de Iacovo et al. | 395/2.32 |
| 5,371,853 | 12/1995 | Kao et al. | 395/2.32 |

FOREIGN PATENT DOCUMENTS

| | | |
|---|---|---|
| 0462559A2 | 12/1991 | European Pat. Off. . |
| 0492459A3 | 7/1992 | European Pat. Off. . |

OTHER PUBLICATIONS

"Low–Delay vector excitation coding of speech at 16 Kb/s", IEEE Transactions on Communications, Jan. 1992, vol. 40, Issue No. 1 pp. 129–139.

"Low–Delay analysis–by–synthesis speech coding using lattice predictors", Globe com '90: IEEE Global Telecommunications Conference.

Dymarski, "Successive orthogonalizations in the multistage CELP coder", Mar. 23, 1992, pp. 61–64, vol. 1, Int'l Conf. on Acoustics Speech and Signal; Calf. USA.

Dymarski et al; "Optimal and sub–optimal algorithms for selecting the excitation in linear predictive coders": Apr. 1990, pp. 485–488; vol. 1 Int'l Conf. on Acoustics Speech and Signal Processing; Mexico USA.

Chen, "Real–time vector APC speech coding at 4800 BPS with adaptive postfiltering", Apr. 1987, pp. 2185–2188, vol. 4, Int'l Conf. on Acoutics Speech and Signal Processing; Dallas, Texas.

*Primary Examiner*—Allen R. MacDonald
*Assistant Examiner*—Thomas J. Onka
*Attorney, Agent, or Firm*—Larson & Taylor

[57] ABSTRACT

A system for predictive coding of a digital speech signal with embedded codes used in any transmission system or for storing speech signals. The coded digital signal ($S_n$) is formed by a coded speech signal and, if appropriate, by auxiliary data. A perceptual weighting filter is formed by a filter for short-term prediction of the speech signal to be coded, in order to produce a frequency distribution of the quantization noise. A circuit makes it possible to perform the subtraction from the perceptual signal $\ddot{P}_n$. of the contribution of the past excitation signal $\hat{P}^0_n$ to deliver an updated perceptual signal $P_n$. A long-term prediction circuit is formed, as a closed loop, from a dictionary updated by the modelled page excitation $\hat{r}^1_n$ for the lowest throughput and makes it possible to deliver an optimal waveform and an associated estimated gain which make up the estimated perceptual signal $\hat{P}^1_n$. An orthonormal transform module includes an adaptive transform module and a module for progressive modelling by orthogonal vectors, thus making it possible to deliver indices representing the coded speech signal. A circuit makes it possible to insert auxiliary data by stealing bits from the coded speech signal. Decoding is performed through extraction of datasignal and transmission of indices representing coded speech signal which is modelled at the minimum throughput.

11 Claims, 16 Drawing Sheets

SYSTEM FOR PREDICTIVE CODING/DECODING OF A DIGITAL SPEECH SIGNAL BY EMBEDDED-CODE ADAPTIVE TRANSFORM

The present invention relates to a system for predictive coding/decoding of a digital speech signal by embedded-code adaptive transform.

Figure 1:
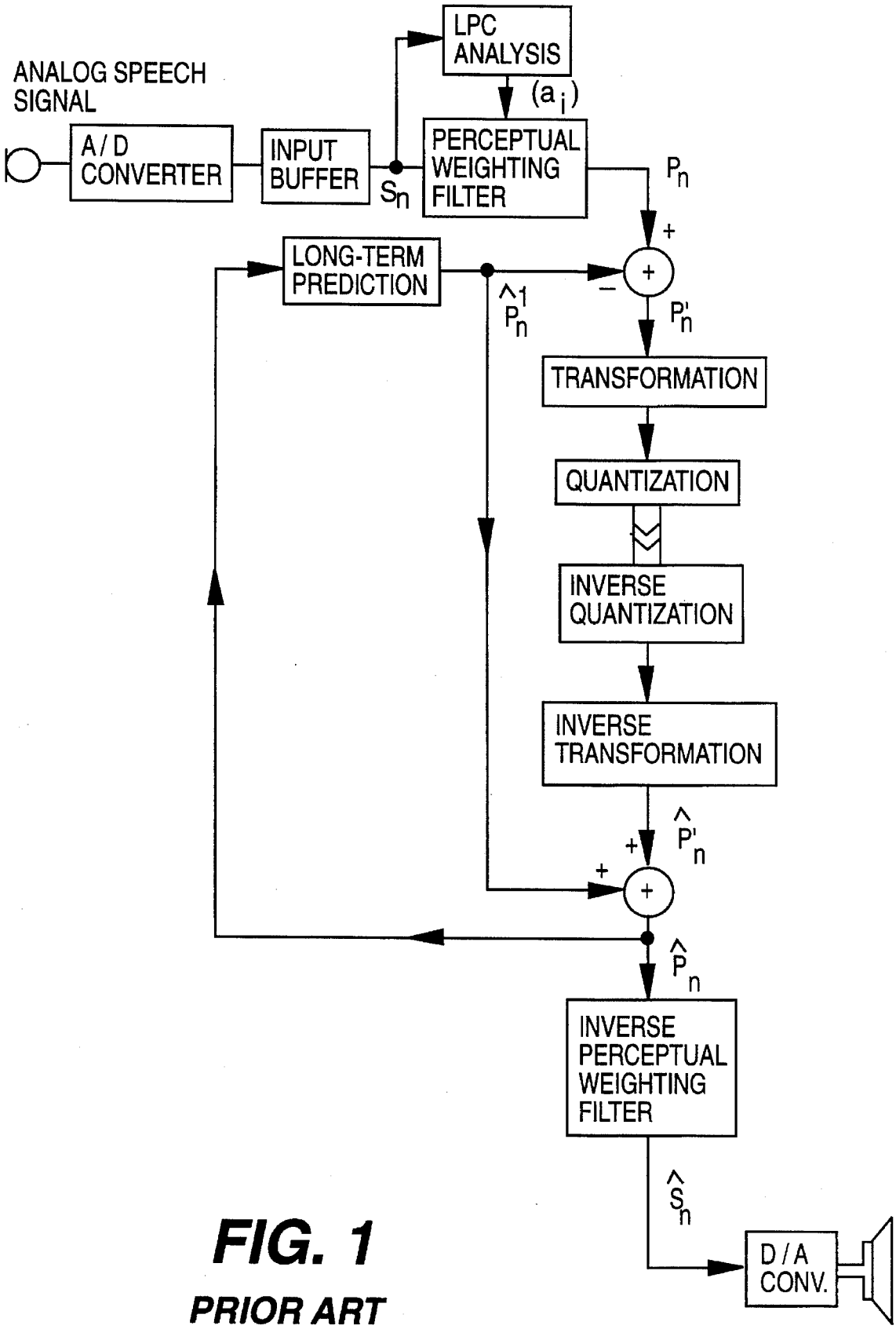
FIG. 1 PRIOR ART

In the currently used predictive transform coders, this type of coder being represented in FIG. 1, it is sought to construct a synthetic signal $\hat{S}n$ resembling as closely as possible the digital speech signal to be coded Sn, resemblance in the sense of a perceptual criterion.

The digital signal to be coded Sn, arising from an analog source speech signal, is subjected to a short-term prediction process, LPC analysis, the prediction coefficients being obtained by predicting the speech signal over windows including M samples. The digital speech signal to be coded Sn is filtered by means of a perceptual weighting filter W(z) deduced from the aforesaid prediction coefficients, to obtain the perceptual signal pn.

A long-term prediction process later makes it possible to take into account the periodicity of the residual for the voiced sounds, over all the sub-windows of N samples, N<M, in the form of a contribution $\hat{P}_n$ which is subtracted from the perceptual signal pn so as to obtain the signal p'n in the form of a vector $P' \epsilon R^N$.

A transformation followed by a quantization are then carried out on the aforesaid vector P' with a view to performing a digital transmission. The inverse operations make it possible, after transmission, to model the synthetic signal $\hat{S}_n$.

To obtain good perceptual behaviour, according to the customary criteria established by experience, it is necessary to establish a process of transformation by orthonormal transform F and of quantization of the vector P', in the presence of values of gain G satisfying well-determined properties, $G=F^T \cdot P'$ where $F^T$ denotes the matrix transpose of the matrix F.

A first solution, proposed by G. Davidson and A. Gersho, in the publication "Multiple-Stage Vector Excitation Coding of Speech Wave forms", ICASSP 88, Vol. 1, pp 163–166, consists in using a non-singular transformation matrix $V=HC$ where H is a lower triangular matrix and C a non-singular dictionary, constructed by learning, ensuring the invertibility of the transformation matrix V for every sub-window.

So as to be able to utilize certain decorrelation and ordering properties of the components of the vector of coefficients of the transform G during the quantization step, several solutions using orthonormal transforms have been proposed.

The Karhunen-Loeve transform, obtained from the eigenvectors of the auto-correlation matrix $$\sum_{i=0}^{I} P'_i P'^T_i$$

where I is the number of vectors held in the learning corpus, makes it possible to maximize the expression $$\sum_{i=1}^{K} G_i^2$$

where K is an integer, K≦N. It is proven that the mean square error of the Karhunen-Loeve transform is less than that of any other transformation for a given order of modelling K, this transform being, in this sense, optimal. This type of transform has been introduced in a predictive orthogonal transform coder by N. Moreau and P. Dymarski, see the publication "Successive Orthogonalisations in the Multistage CELP Coder", ICASSP 92 Vol. 1, pp I-61–I-64.

However, so as to reduce the complexity of computing the gain vector G, it is possible to use sub-optimal transforms, such as the Fast Fourier Transform (FFT), the discrete cosine transform (DCT), the Hadamard discrete transform (HDT) or Walsh Hadamard discrete transform (WHDT) for example.

Another method of constructing an orthonormal transform consists in a singular-value decomposition of the lower triangular Toeplitz matrix H defined by:

$$H = \begin{bmatrix} h(0) & 0 & 0 & & 0 \\ h(1) & h(0) & . & & 0 \\ h(2) & h(1) & . & . & . \\ . & . & . & . & . \\ . & . & . & & . \\ h(N-1) & h(n-2) & . & . & . \; h(0) \end{bmatrix}$$

a matrix in which h(n) is the impulse response of the short-term prediction filter 1/A(z) for the current window.

The matrix H can then be decomposed into a sum of matrices of rank 1:

$$H = UDV^T = \sum_{i=1}^{N} U_i d_i V_i^T$$

The matrix U being unitary, the latter can be used as orthonormal transform. Such a construction has been proposed by B.S. Atal in the publication "A Model of LPC Excitation in Terms of Eigenvectors of the Autocorrelation Matrix of the Impulse Response of the LPC Filter", ICASSP 89, Vol. 1, pp 45–48 and by E. Ofer in the publication "A Unified Framework for LPC Excitation Representation in Residual Speech Coders" ICASSP 89, Vol. 1 pp 41–44.

The currently known embedded-code coders make it possible to transmit data by stealing binary elements normally allocated to speech on the transmission channel, and this, in a way which is transparent to the coder, which codes the speech signal at the maximum throughput.

Among this type of coder, a 64-kbit/s coder with embedded-code scalar quantizer has been standardized in 1986 by the G 722 standard compiled by the CCITT. This coder operating in the wide band speech region (audio signal of 50 Hz to 7 kHz bandwidth, sampled at 16 kHz), is based on coding into two sub-bands each containing an adaptive differential pulse code modulation coder (ADPCM coding). This coding technique makes it possible to transmit wide band speech signals and data, if necessary, over a 64-kbit/s channel, at three different throughputs 64-56-48 kbit/s and 0-8-16 kbit/s for the data.

Furthermore, in the context of the implementation of code-excited coders (or CELP coders) M. Johnson and T. Tanigushi have described an embedded-code multistage CELP coder. See the publication by the above authors entitled "Pitch Orthogonal Code-Excited LPC", Globecom 90, Vol. 1, pp 542–546.

Finally, R. Drogo De Iacovo and D. Sereno have described a coder of modified CELP type making it possible to obtain embedded codes which model the excitation signal of the LPC analysis filter by a sum of various contributions and which use only the first of them to update the memory of the synthesis filter, see the publication by these authors "Embedded CELP Coding For Variable Bit-Rate Between 6.4 and 9.6 kbit/s" ICASSP 91 Vol. 1, pp 681–684.

The aforesaid prior-art predictive transform coders do not make it possible to transmit data and cannot therefore fulfil the function of embedded-code coders. Furthermore, the embedded-code coders of the prior art do not use the orthonormal transform technique, and this does not make it possible to approach or attain optimal coding by transform.

The object of the present invention is to remedy the aforesaid disadvantage by implementing the system for predictive coding/decoding of a digital speech signal by embedded-code adaptive transform.

Another subject of the present invention is the implementation of a system for predictive coding/decoding of a digital speech signal and data allowing transmission at reduced and flexible throughputs.

The system for predictive coding of a digital signal as an embedded-code digital signal, in which the coded digital signal consists of a coded speech signal and, if appropriate, of an auxiliary data signal inserted into the coded speech signal after coding the latter, which is the subject of the present invention, comprises a perceptual weighting filter driven by a short-term prediction loop allowing the generation of a perceptual signal and a long-term prediction circuit delivering an estimated perceptual signal, this long-term prediction circuit forming a long-term prediction loop making it possible to deliver, from the perceptual signal and from the estimated past excitation signal, a modelled perceptual excitation signal, and adaptive transform and quantization circuits making it possible from the perceptual excitation signal to generate the coded speech signal.

It is notable in that the perceptual weighting filter consists of a filter for short-term prediction of the speech signal to be coded, so as to produce a frequency distribution of the quantization noise, and in that it comprises a circuit for subtracting the contribution of the past excitation signal from the perceptual signal to deliver an updated perceptual signal, the long-term prediction circuit being formed, as a closed loop, from a dictionary updated by the modelled past excitation corresponding to the lowest throughput making it possible to deliver an optimal waveform and an estimated gain associated therewith, which make up the estimated perceptual signal. The transform circuit is formed by an orthonormal transform module including an adaptive orthogonal transformation module and a module for progressive modelling by orthogonal vectors. The progressive modelling module and the long-term prediction circuit make it possible to deliver indices representing the coded speech signal. A circuit for inserting auxiliary data is coupled to the transmission channel.

The system for predictive decoding by adaptive transform of a digital signal coded with embedded codes in which the coded digital signal consists of a coded digital signal and, if appropriate, of an auxiliary data signal inserted into the coded speech signal after coding the latter, is notable in that it includes a circuit for extracting the data signal making it possible, on the one hand, to extract data with a view to an auxiliary use, and on the other hand, to transmit the indices representing the coded speech signal. It furthermore comprises a circuit for modelling the speech signal at the minimum throughput and a circuit for modelling the speech signal at at least one throughput above the minimum throughput.

The system for predictive coding/decoding of a digital speech signal by embedded-code adaptive transform which is the subject of the present invention finds application, in general, to the transmission of speech and data at flexible throughputs and, more particularly, to the protocols for audio-visual conferences, to video phones, to telephony over loudspeakers, to the storing and transporting of digital audio signals over long-distance links, to transmission with mobiles and path-concentration systems.

Figure 2:
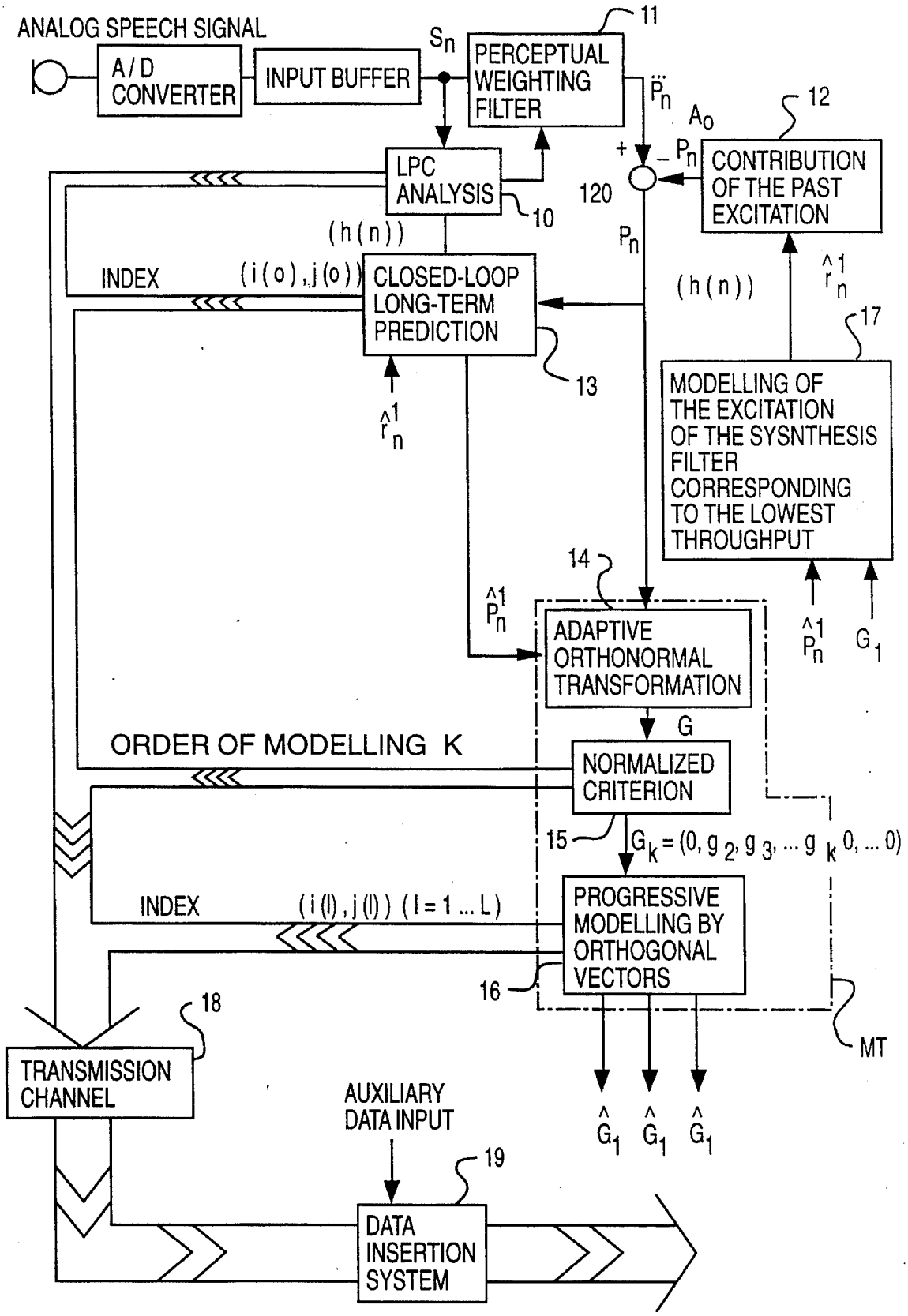
Figure 3:
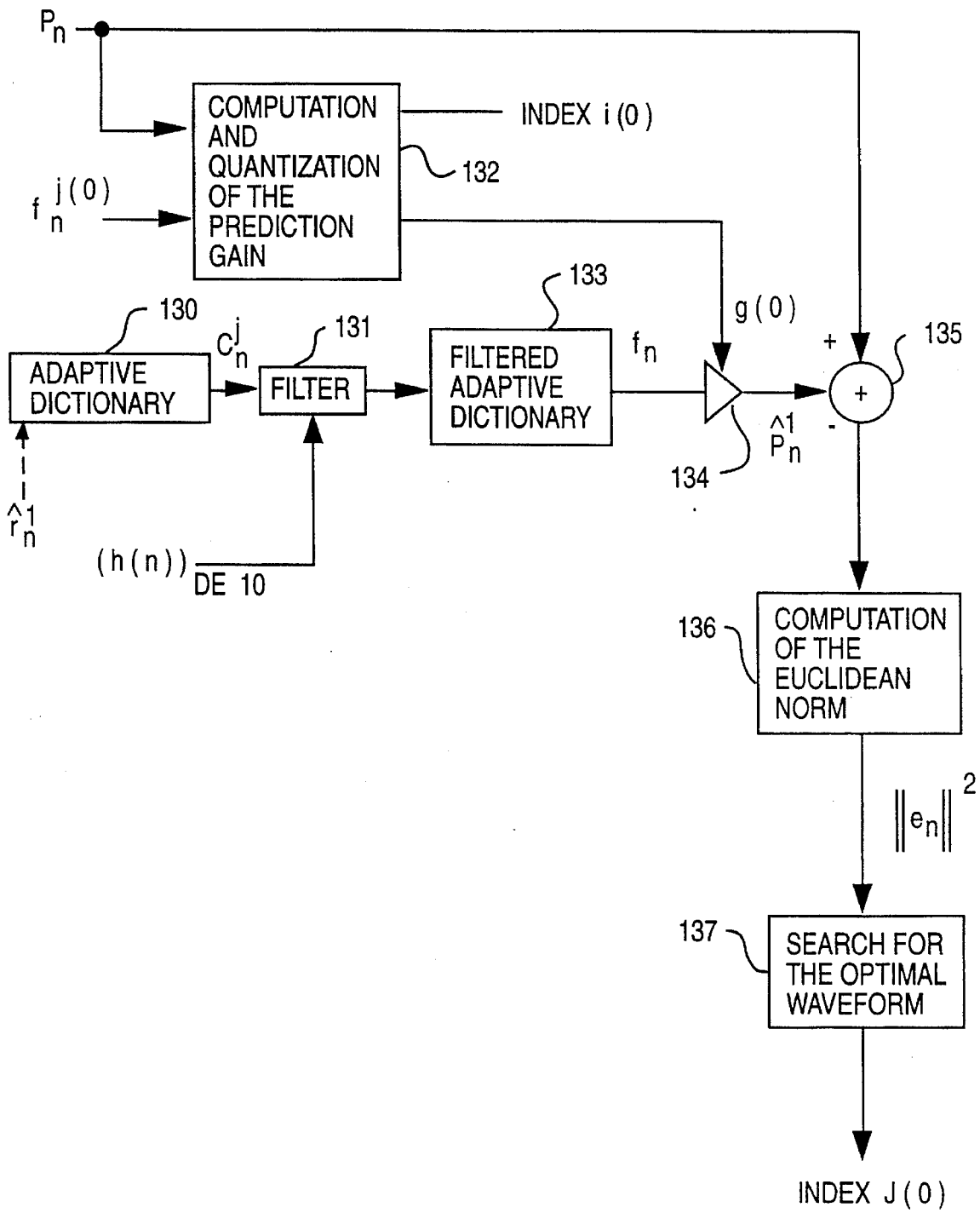
Figure 4A:
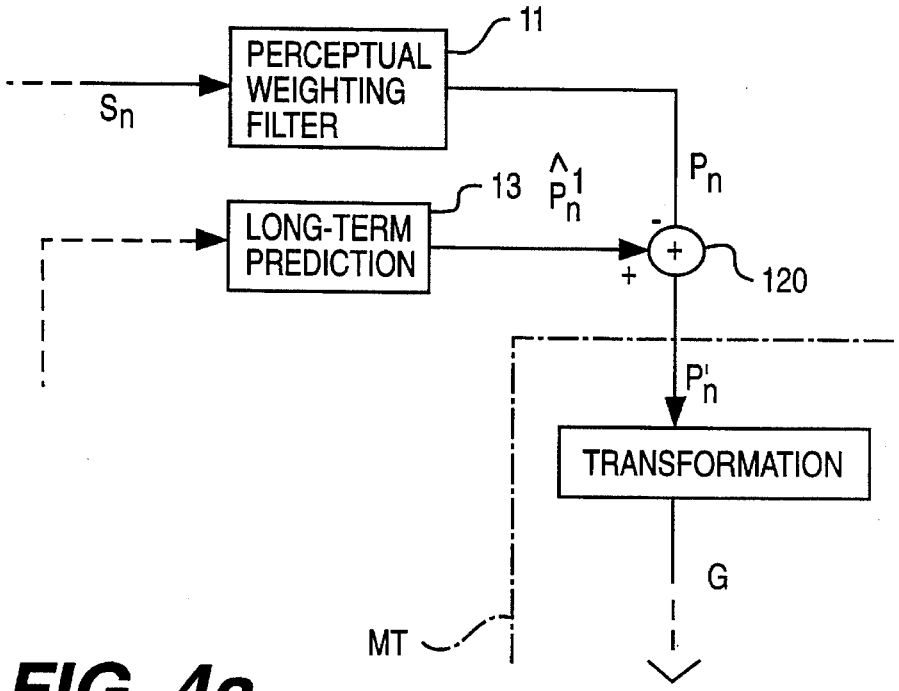
Figure 4B:
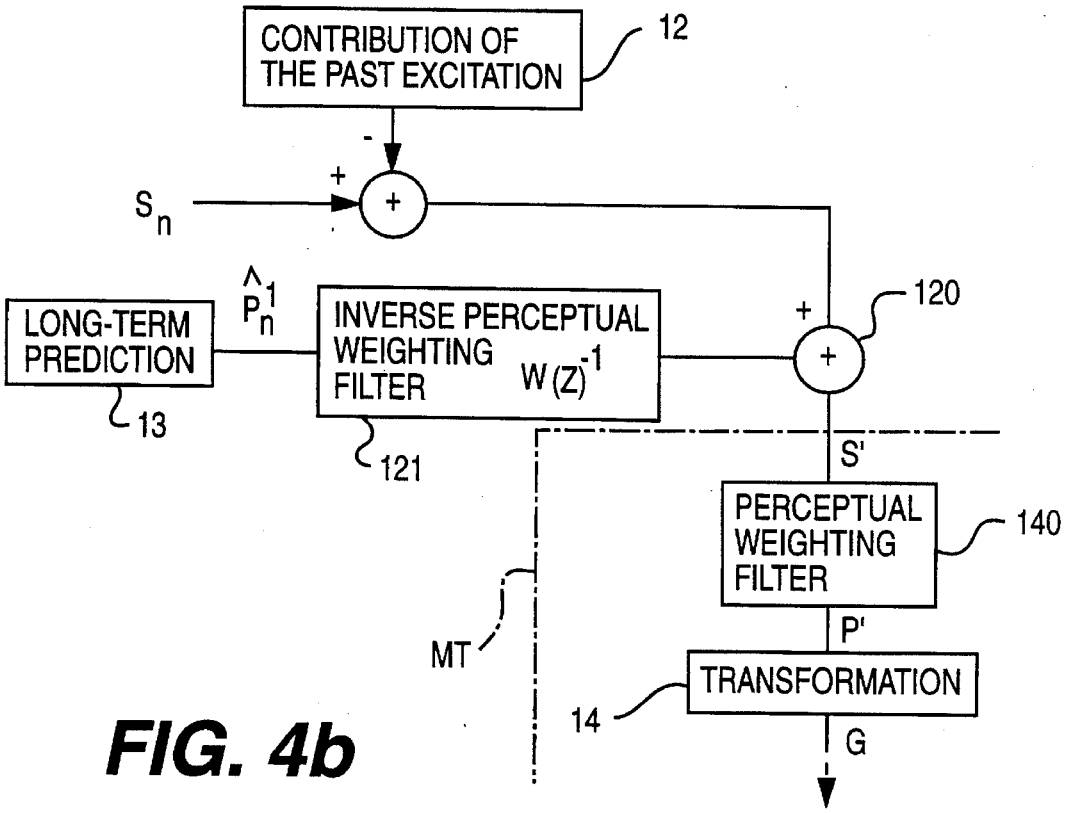
Figure 5A:
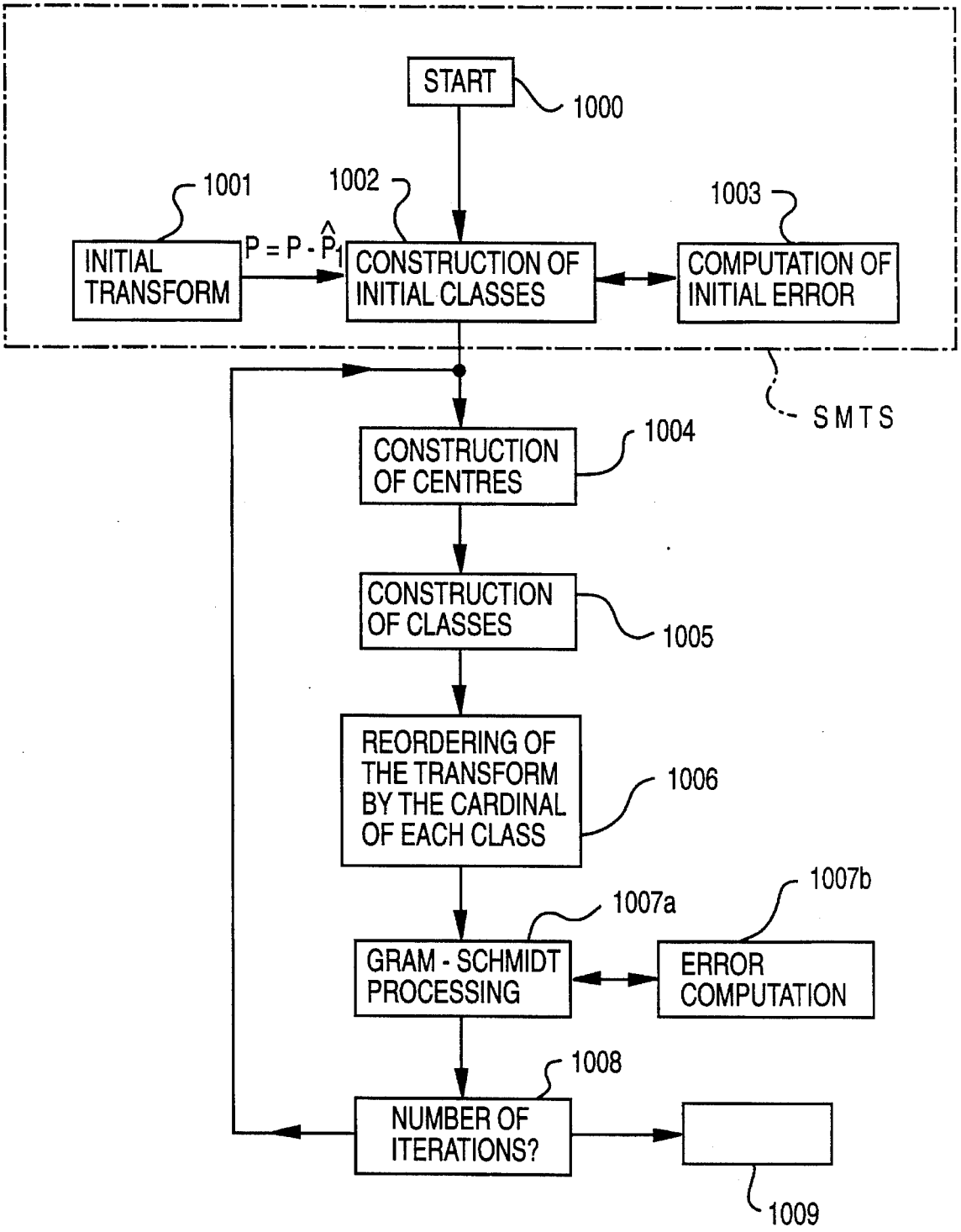
Figure 5B:
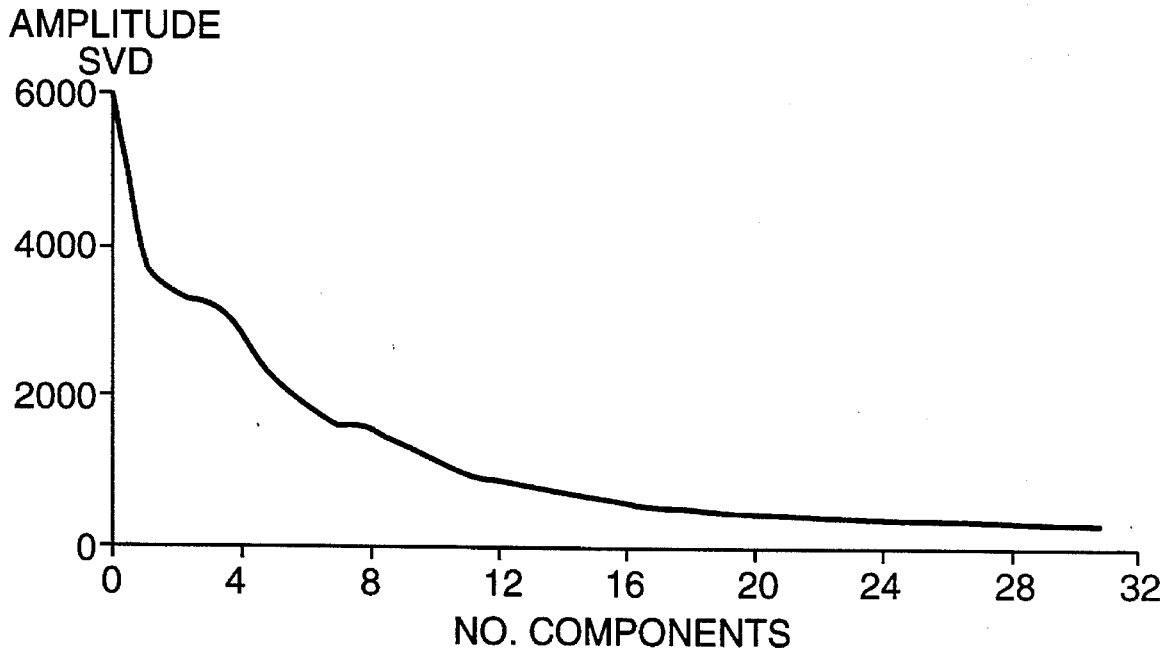
Figure 5C:
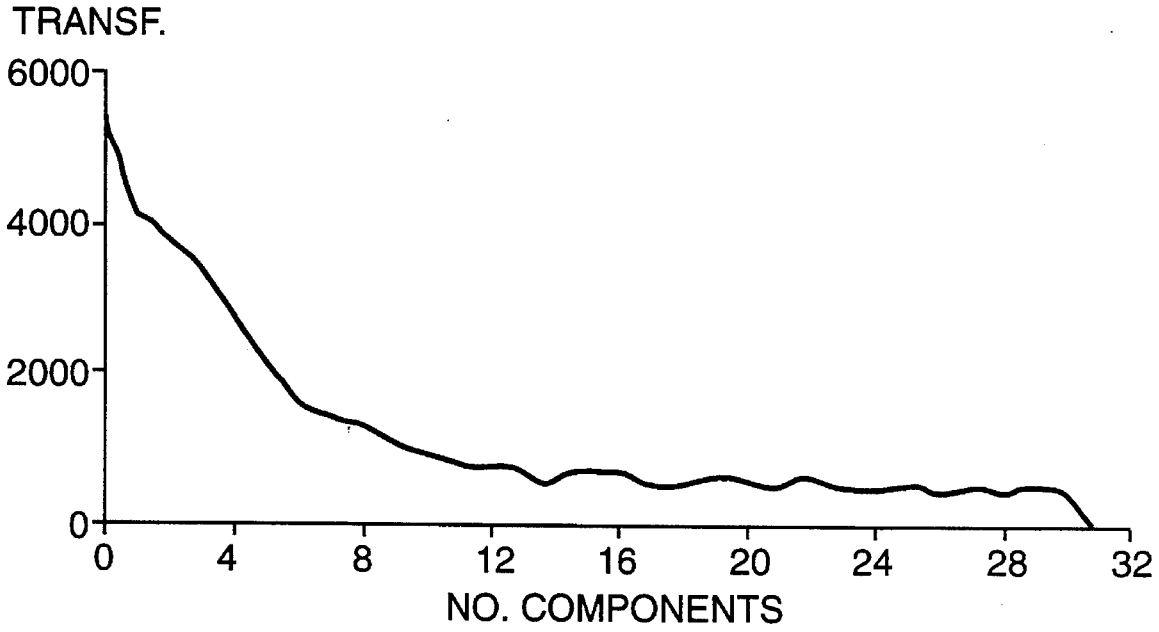
Figure 6A:
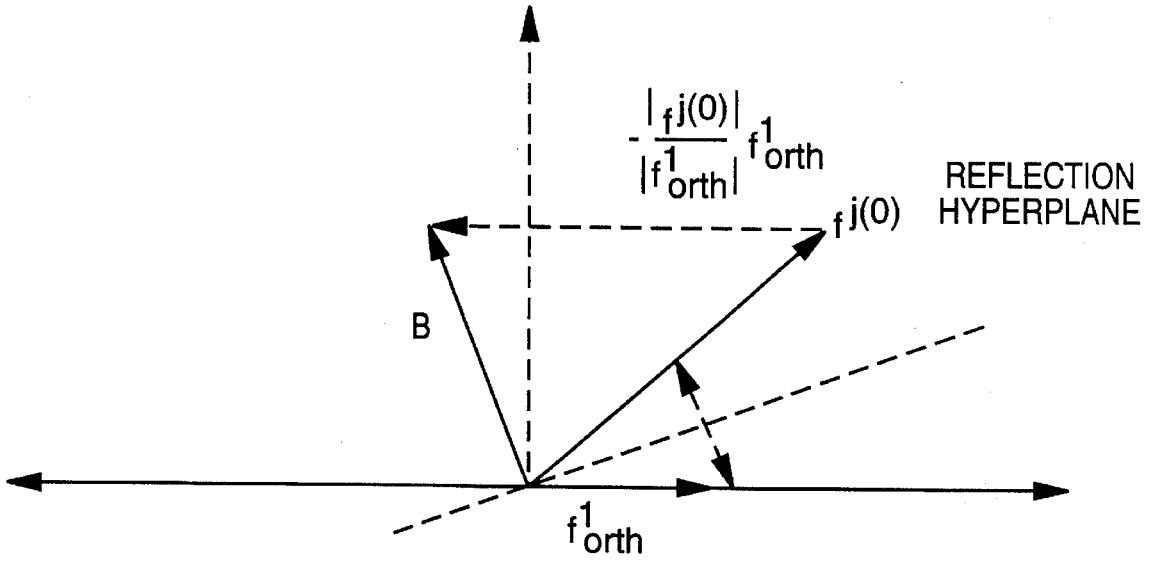
Figure 6B:
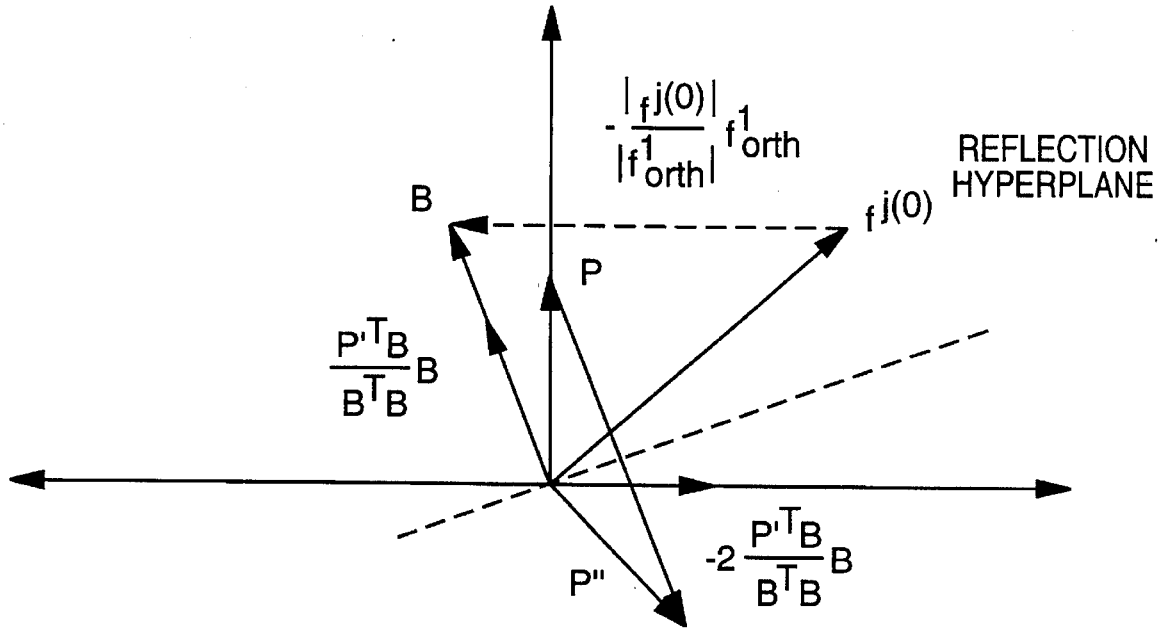
Figure 7:
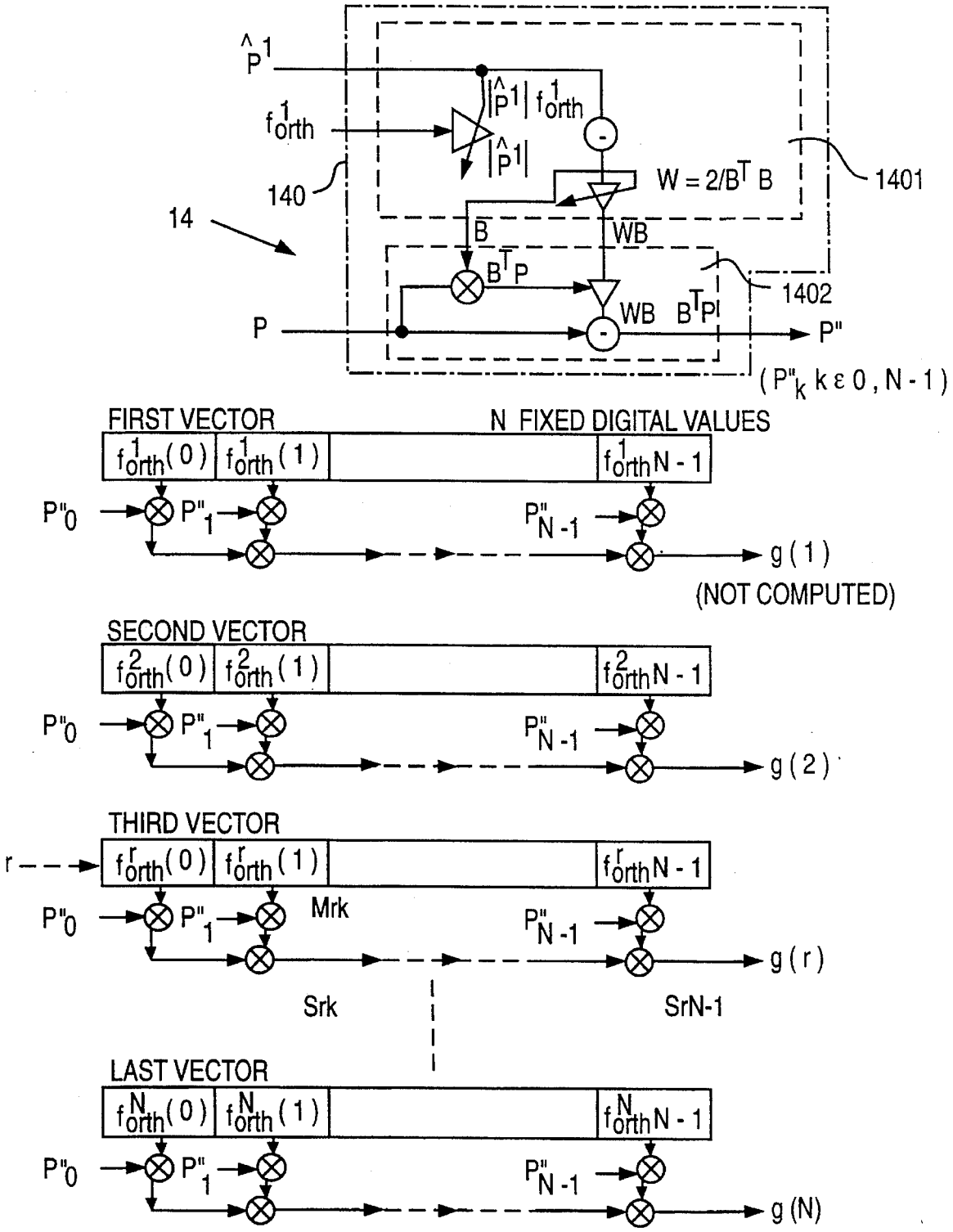
Figure 8A:
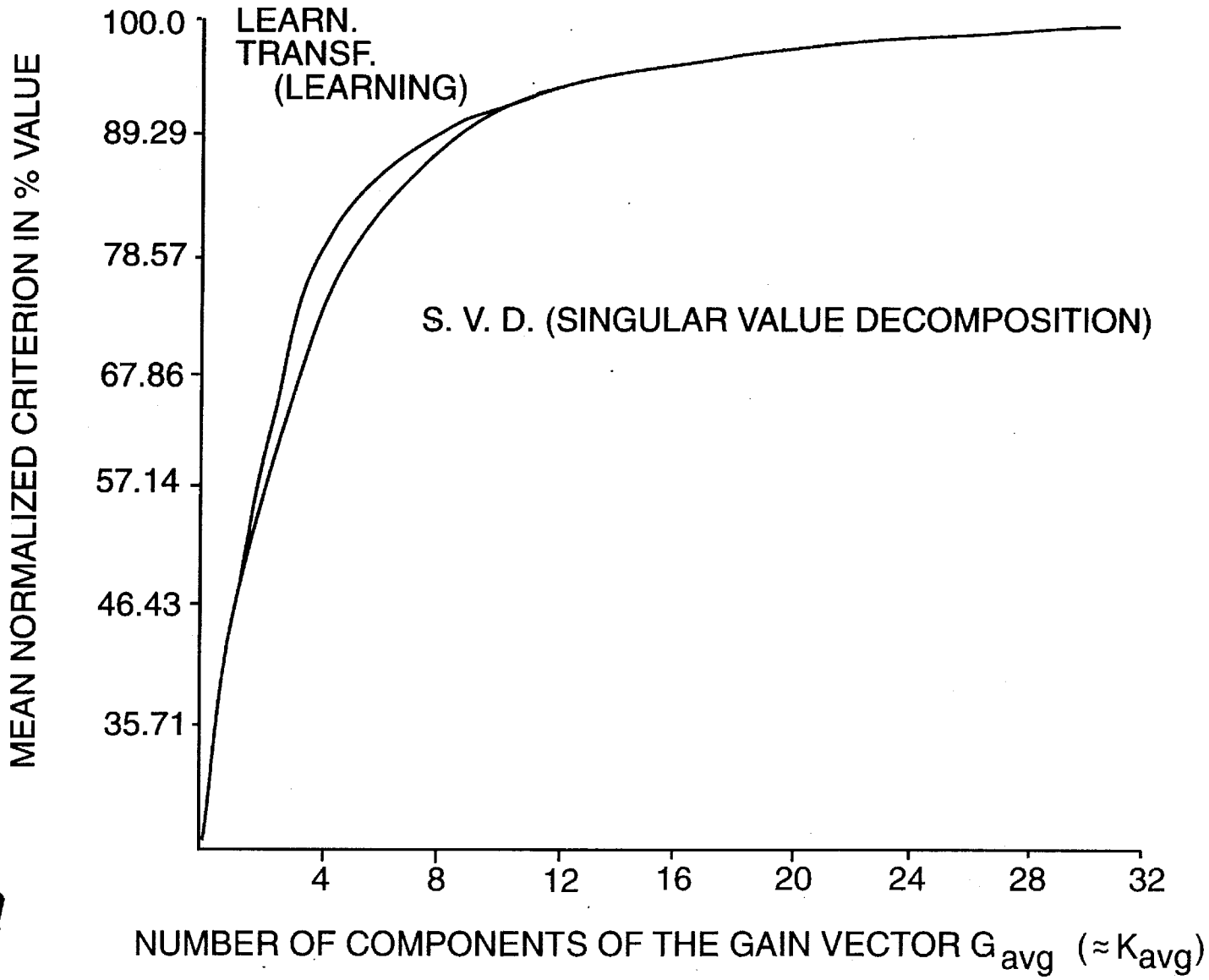
Figure 8B:
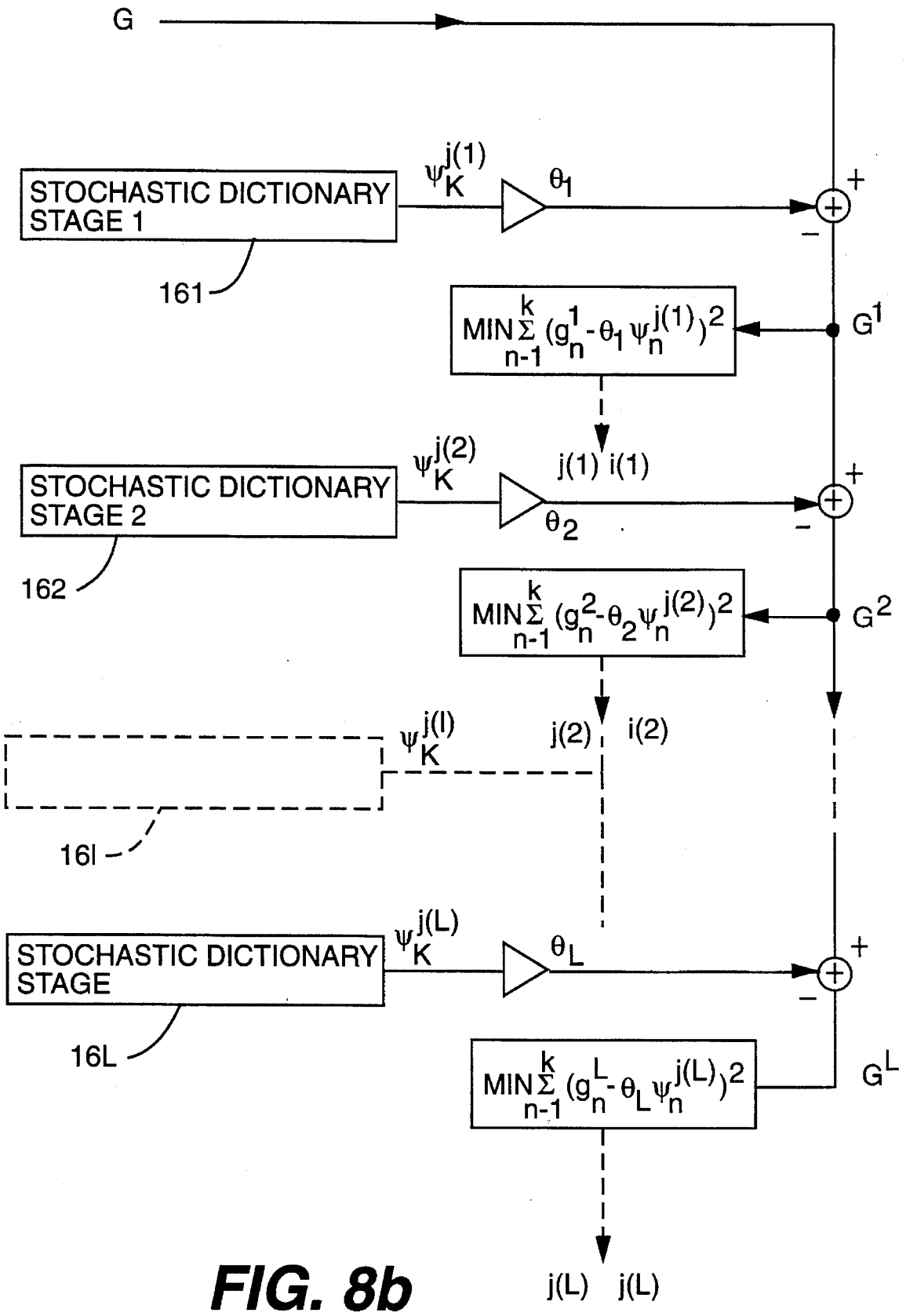
Figure 9:
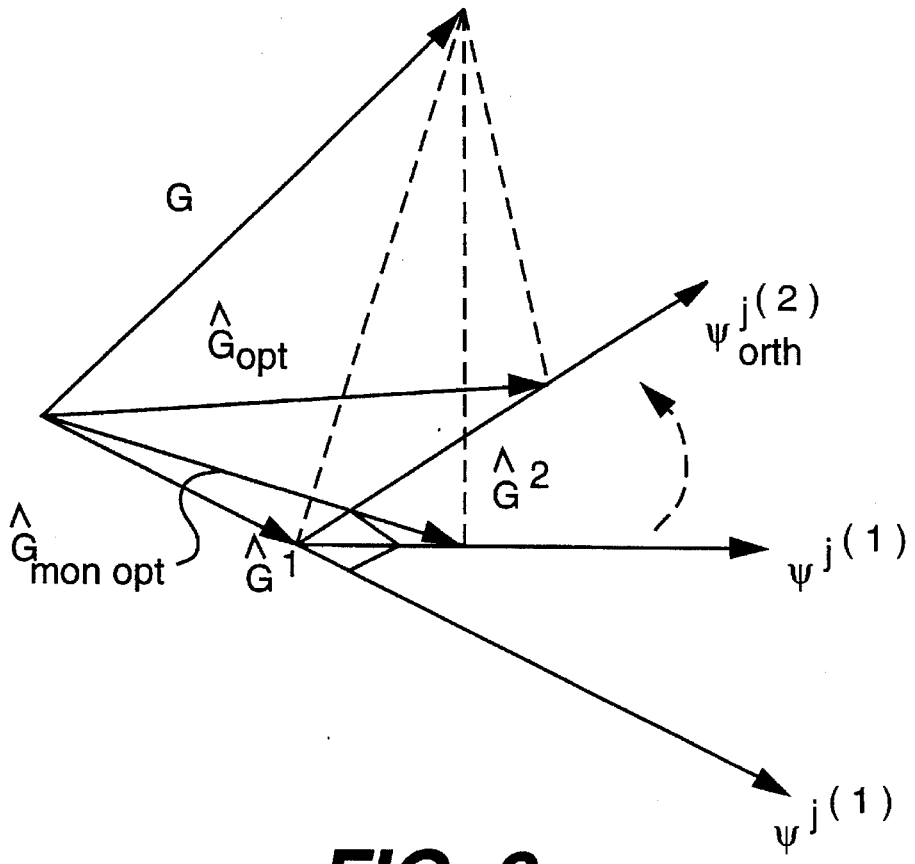
Figure 15:
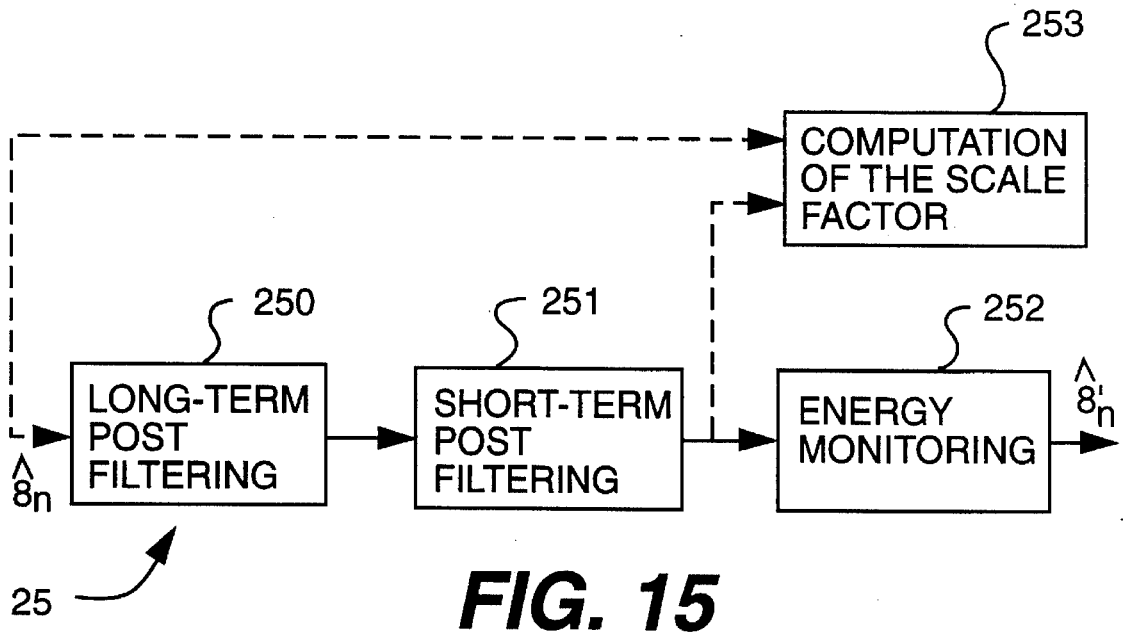
Figure 10A:
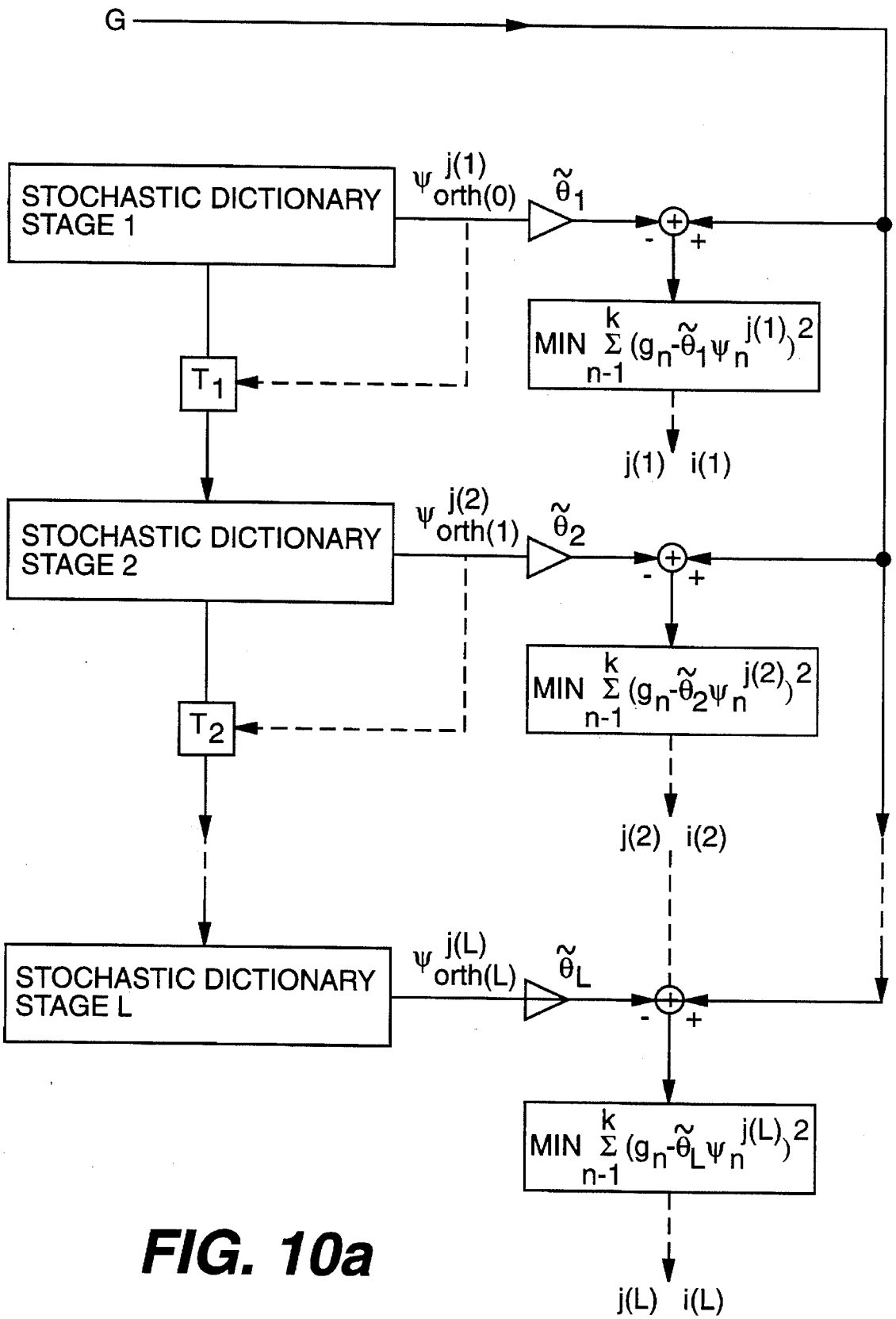
Figure 10B:
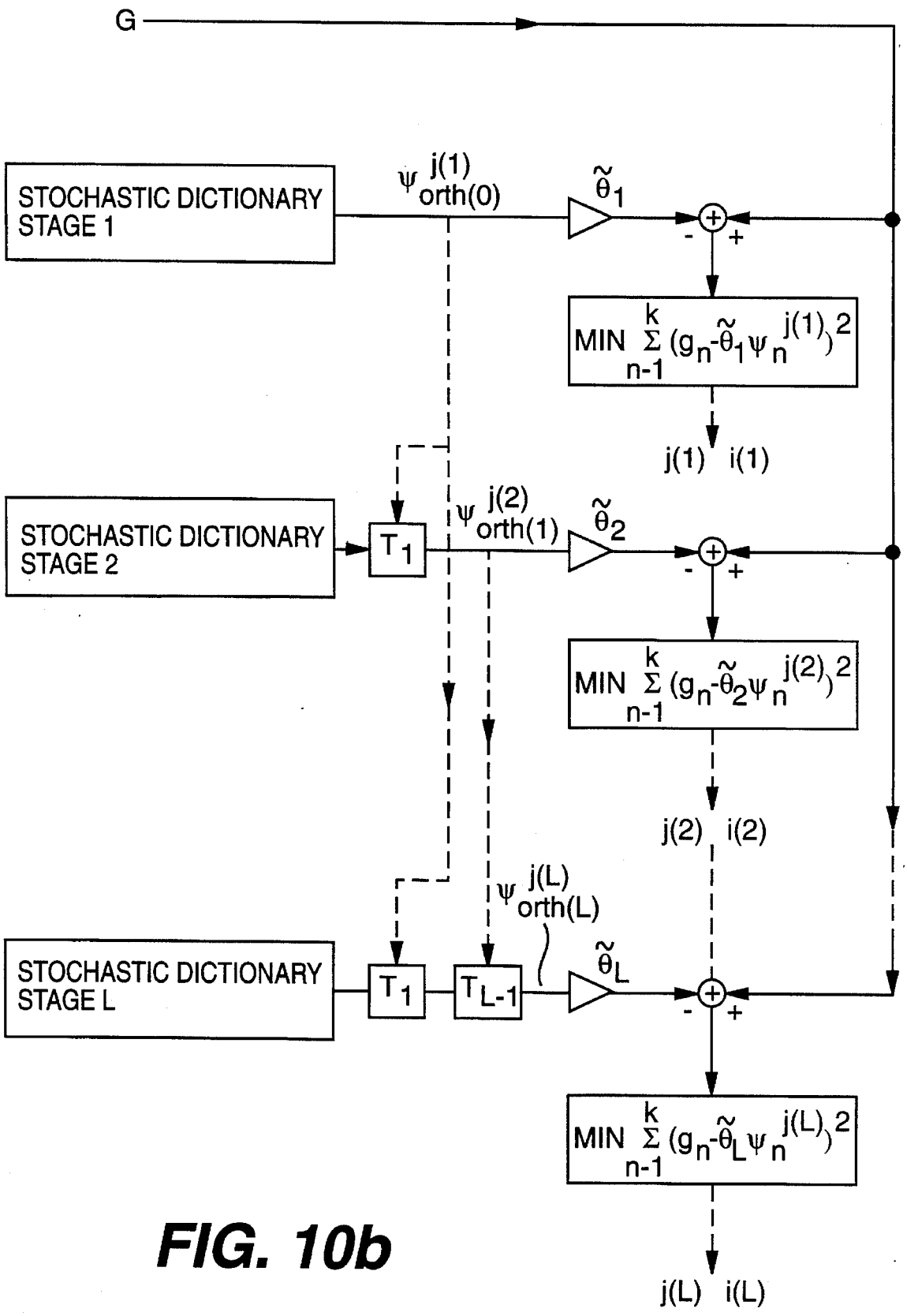
Figure 11:
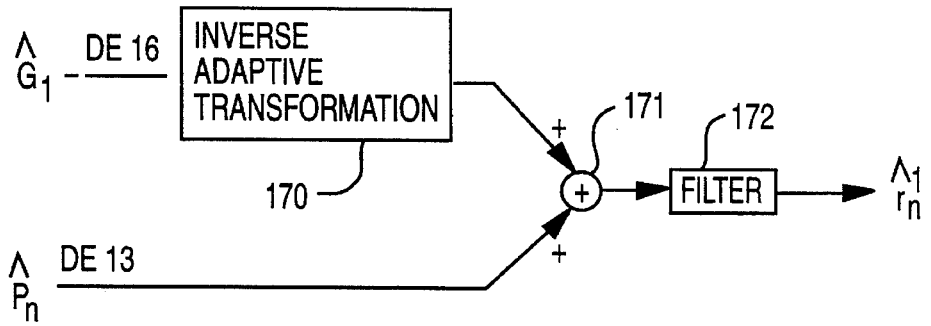
Figure 12:
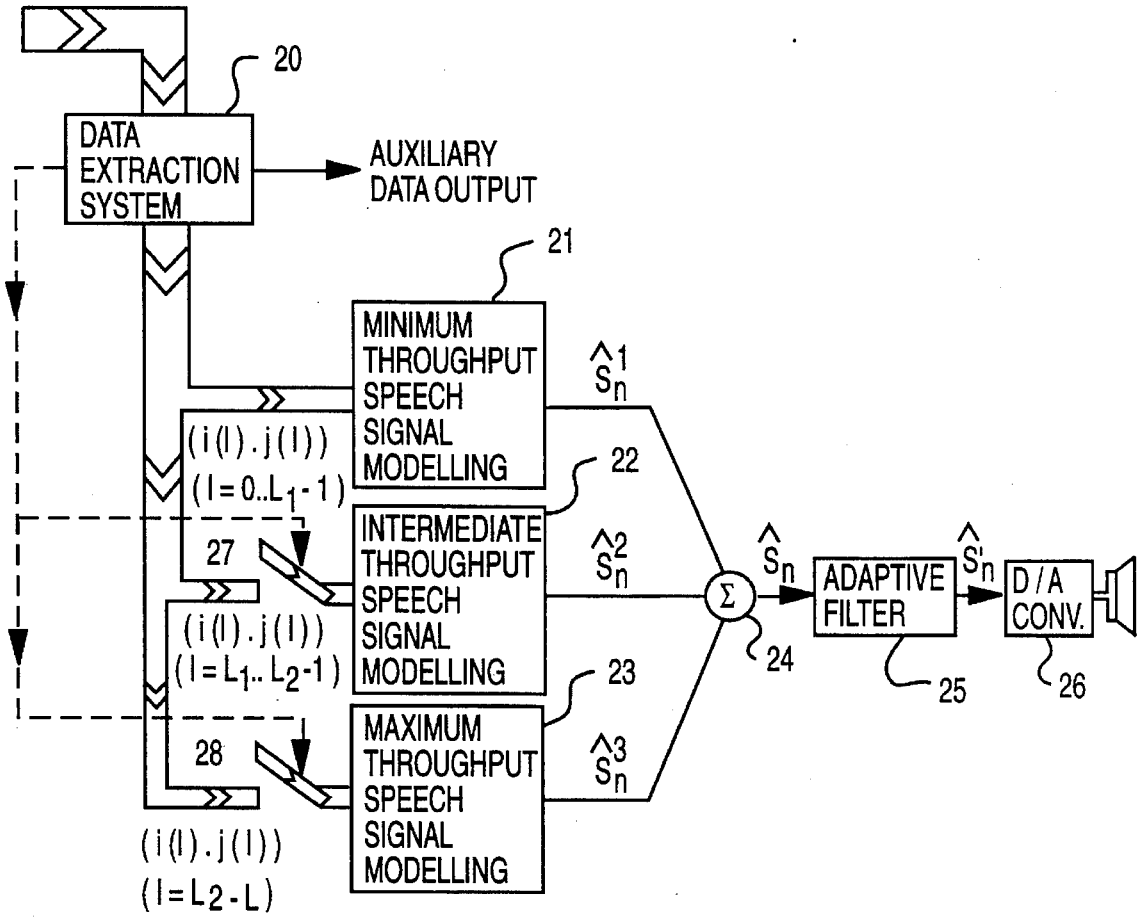
Figure 13A:
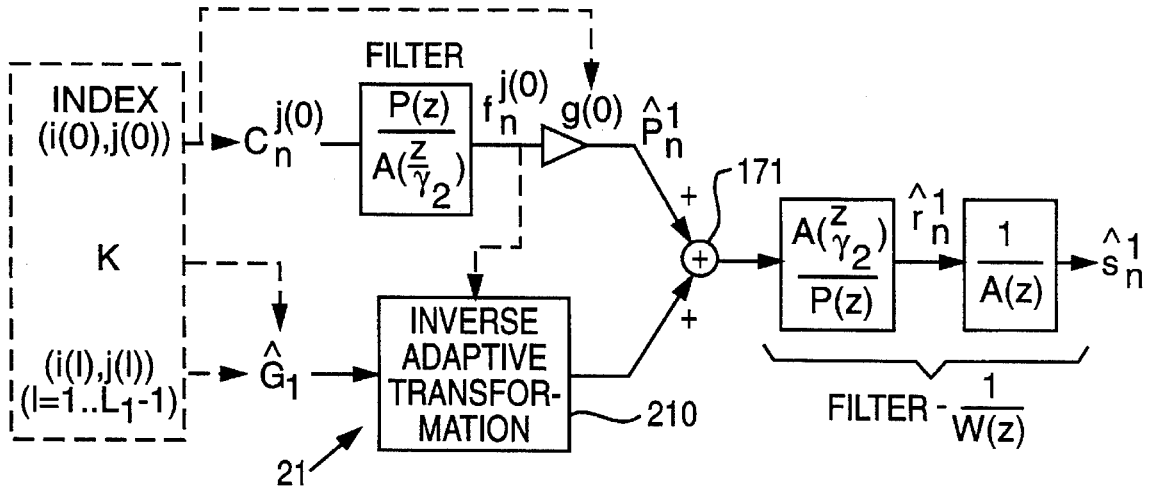
Figure 14A:
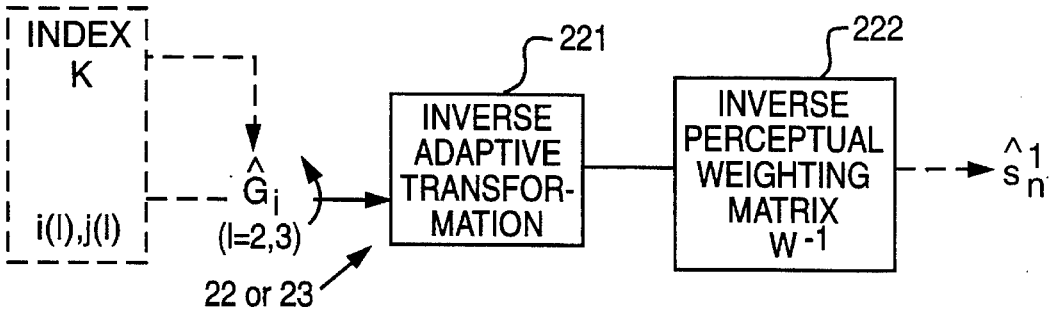
Figure 14B:
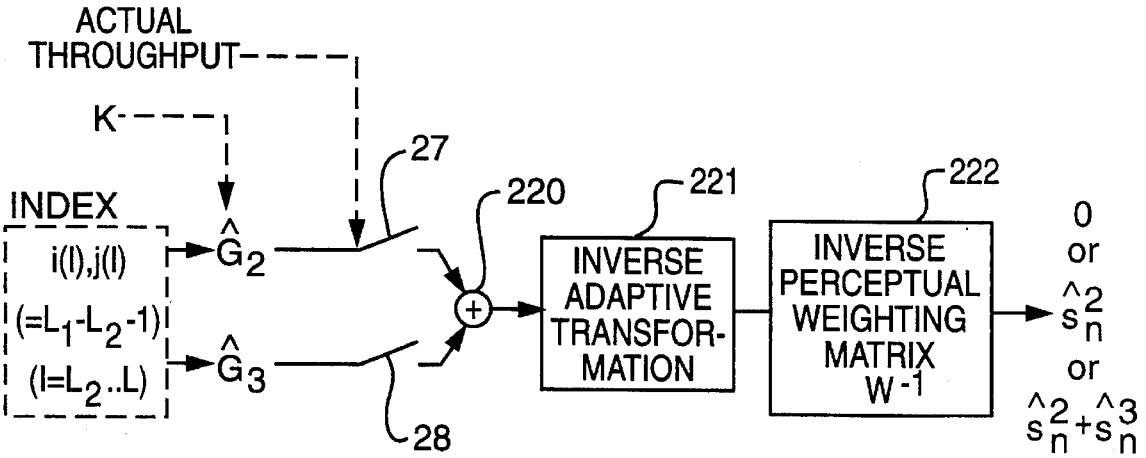
Figure 13B:
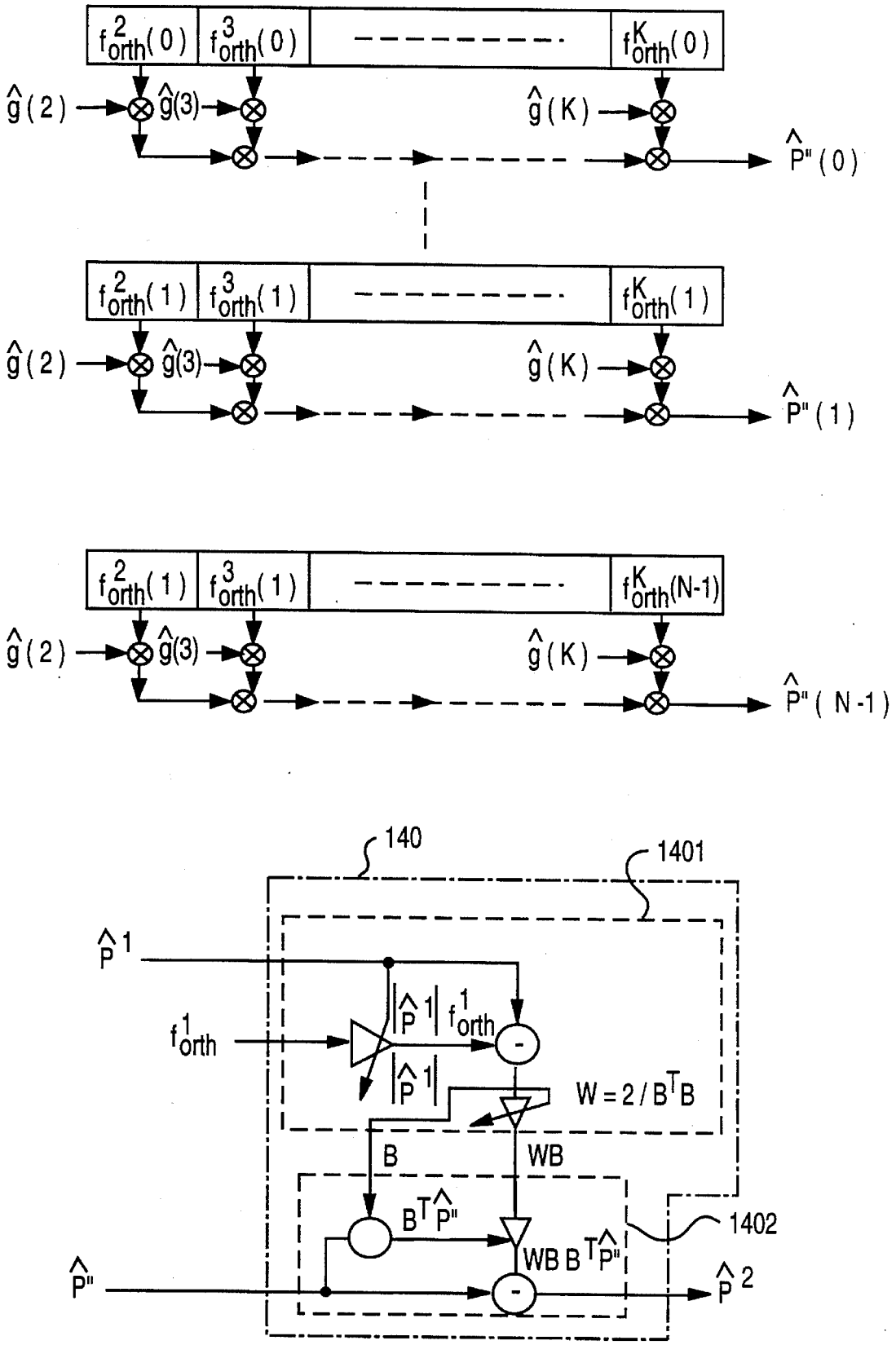

A more detailed description of the coding/ decoding system which is the subject of the present invention will be given below in connection with the drawings in which, apart from FIG. 1 relating to the prior art and referring to a predictive transform coder, FIG. 2 represents a basic diagram of the system for predictive coding of a speech signal by embedded-code adaptive transform which is the subject of the present invention, FIG. 3 represents an embodiment detail of a closed-loop long-term prediction module used in the coding system represented in FIG. 2, FIGS. 4*a* and 4*b* represent a partial diagram of a predictive transform coder and a diagram equivalent to the partial diagram of FIG. 4*a*, FIG. 5*a* represents a flow chart of an orthonormal transform process constructed by learning, FIG. 5*b* and 5*c* represent two graphs comparing normalized values of gain obtained by respective singular-value decomposition by learning, FIGS. 6*a* and 6*b* represent diagrammatically the Householder transformation process applied to the perceptual signal, FIG. 7 represents an adaptive transformation module implementing a Householder transformation, FIG. 8*a* represents, for the singular-value decomposition respectively the construction for learning, a normalized criterion for gain as a function of the number of components of the gain vector, FIG. 8*b* represents a basic diagram of multistage vector quantization in which the gain vector $\hat{G}$ is obtained by linear combination of the vectors arising from stochastic dictionaries, FIG. 9 is a geometric representation of the forecast of the gain vector G in a subspace of vectors arising from stochastic dictionaries, FIGS. 10*a* and 10*b* represent the basic diagram of a process for vector quantization of gain by progressive orthogonal modellings, corresponding to an optimal projection of this gain vector represented in FIG. 9, in the case of just one respectively of several stochastic dictionaries, FIG. 11 represents an embodiment of the modelling of the excitation of the synthesis filter corresponding to the lowest throughput, FIG. 12 represents a basic diagram of a system for predictive decoding of a speech signal by embedded-code adaptive transform which is the subject of the present invention, FIG. 13*a* represents a basic diagram of a module for modelling the speech signal at the minimum throughput, FIG. 13*b* represents an embodiment of an inverse orthonormal transformation module, FIG. 14*a* represents a diagram of a module for modelling the speech signal at throughputs other than the minimum throughput, FIG. 14*b* represents a diagram equivalent to the modelling module represented in FIG. 14*a*, FIG. 15 represents the implementation of a post-filtering adaptive filter intended to improve the perceptual quality of the synthesis speech signal $\hat{S}n$.

A more detailed description of a system for predictive coding of a digital speech signal by adaptive transform as an embedded-code digital signal will now be given in connection with FIG. 2 and the succeeding figures.

Generally, it is supposed that the digital signal coded by the implementation of the coding system which is the subject of the present invention consists of a coded speech signal and if appropriate of an auxiliary data signal inserted into the coded speech signal, after coding this digital speech signal.

Of course, the coding system which is the subject of the present invention can comprise, starting from a transducer delivering the analog speech signal, an analog/digital converter and an input storage circuit or input buffer making it possible to deliver the digital signal to be coded Sn.

The coding system which is the subject of the present invention also comprises a perceptual weighting filter 11 driven by a short-term prediction loop making it possible to generate a perceptual signal, labelled $\ddot{P}_n$.

It also comprises a long-term prediction circuit, labelled 13, delivering an estimated perceptual signal which is labelled $\hat{P}_n^1$.

The long-term prediction circuit 13 forms a long-term prediction loop making it possible to deliver, from the perceptual signal and from the estimated past excitation signal, labelled $\hat{P}_n^0$, a modelled perceptual excitation signal.

The coding system which is the subject of the present invention such as represented in FIG. 2 furthermore includes an adaptive transform and quantization circuit making it possible from the perceptual excitation signal $P_n$ to generate the coded speech signal as will be described later in the description.

According to a first particularly advantageous aspect of the coding system which is the subject of the present invention the perceptual weighting filter 11 consists of a filter for short-term prediction of the speech signal to be coded, so as to produce a frequency distribution of the quantization noise. The perceptual weighting filter 11 delivering the perceptual signal $\ddot{P}_n$, the coding device according to the invention thus comprises as represented in the same FIG. 2 a circuit 120 for subtracting the contribution of the past excitation signal $\hat{P}_n^0$ from the perceptual signal to deliver an updated perceptual signal, this updated perceptual signal being labelled $P_n$.

According to another particularly advantageous characteristic of the coding device which is the subject of the present invention, the long-term prediction circuit 13 is formed as a closed loop from a dictionary updated by the modelled past excitation corresponding to the lowest throughput, this dictionary making it possible to deliver an optimal waveform and an estimated gain associated therewith. In FIG. 2, the modelled past excitation corresponding to the lowest throughput is labelled $\hat{r}_n^1$. It is moreover indicated that the optimal waveform and the estimated gain associated therewith make up the estimated perceptual signal $\hat{P}_n^1$ delivered by the long-term prediction circuit 13.

According to another characteristic of the coding system which is the subject of the present invention, as represented in FIG. 2, the transform module circuit, labelled MT, is formed by an orthonormal transform module 14, including an adaptive orthogonal transformation module properly speaking and a module for progressive modelling by orthogonal vectors, labelled 16.

In accordance with a particularly advantageous aspect of the coding system which is the subject of the present invention, the module for progressive modelling 16 and the long-term prediction circuit 13 make it possible to deliver indices representing the coded speech signal, these indices being labelled i(0), j(0) respectively i(l), j(l) with l ∈[1,L] in FIG. 2.

Finally, the coding system according to the invention furthermore comprises a circuit 19 for inserting auxiliary data, coupled to the transmission channel, labelled 18.

The operation of the coding device which is the subject of the present invention can be illustrated in the manner below.

As indicated earlier, it is sought to reproduce a synthetic signal $\hat{S}_n$ perceptually resembling as close as possible the digital signal to be coded The synthetic signal $\hat{S}_n$ is of course the signal reproduced on reception, that is to say at decoding level after transmission as will be described later in the description.

A short-term prediction analysis formed by the analysis circuit 10 of LPC type for "Linear Predictive Coding" and by the perceptual weighting filter 11 is produced for the digital signal to be coded by a conventional technique for prediction over windows including for example M samples. The analysis circuit 10 then delivers the coefficients $a_i$, where the aforesaid coefficients $a_i$ are the linear prediction coefficients.

The speech signal to be coded Sn is then filtered by the perceptual weighting filter 11 with transfer function W(z), which makes it possible to deliver the perceptual signal properly speaking, labelled $\ddot{P}_n$.

The coefficients of the perceptual weighting filter are obtained from short-term prediction analysis on the first few correlation coefficients of the sequence of coefficients $a_i$ of the analysis filter A(z) of the circuit 10 for the current window. This operation makes it possible to produce a good frequency distribution of the quantization noise. Indeed, the perceptual signal delivered is tolerant to more sizable coding noise in the high-energy areas where the noise is less audible, being masked frequency wise by the signal. It is indicated that the perceptual filtering operation is decomposed into two steps, the digital signal to be coded Sn being filtered a first time by the filter consisting of the analysis circuit 10, so as to obtain the residual to be modelled, then a second time by the perceptual weighting filter 11 to deliver the perceptual signal $\ddot{P}_n$.

In the process for operating the coding device which is the subject of the present invention, the second operation consists in then removing the contribution of the past excitation, or estimated past excitation signal, labelled $\hat{P}_n^0$ from the aforesaid perceptual signal.

Indeed, it is shown that:

$$\hat{P}_n = \sum_{i=-\infty}^{-1} \hat{r}_i^1 h_{n-i} + \sum_{i=0}^{n} \hat{r}_i^1 h_{n-i} = \hat{p}_n^0 + \hat{p}_n^1 \quad (1)$$

In this relation, $h_n$ is the impulse response of the twin filtering produced by the circuit 10 and the perceptual weighting filter 11 in the current window and $\hat{r}_n^1$ is the modelled past excitation corresponding to the lowest throughput, as will be described later in the description.

The operational mode of the closed-loop long-term prediction circuit 13 is then as follows. This circuit makes it possible to take into account the periodicity of the residual for the voiced sounds, this long-term prediction being produced every sub-window of N samples, as will be described in connection with FIG. 3.

The closed-loop long-term prediction circuit 13 comprises a first stage consisting of an adaptive dictionary 130, which is updated every aforesaid sub-window by the modelled excitation labelled $\hat{r}_n^1$, delivered by the module 17, which module will be described later in the description. The adaptive dictionary 130 makes it possible to minimize the error, written $$E=\sum_{n=0}^{N-1}((r_n-g_0\hat{r}^1_{n-q})*h(n))^2 \quad (2)$$

with respect to the two parameters $g_0$ and q.

Such an operation corresponds, in the frequency domain, to a filtering by the filter with transfer function:

$$B(z)=\frac{1}{1-g_0z^{-q}} \quad (3)$$

This operation is equivalent to searching for the optimal waveform, labelled $f^{j(0)}$ and for its associated gain $g_0$ from an appropriately constructed dictionary. See the article published by R. Rose and T. Barnwell, entitled "Design and Performance of an Analysis by Synthesis Class of Predictive Speech Coders", IEEE Trans. on Acoustic Speech Signal Processing, September 1990.

The wave form of index j, written $$C_n^j=\hat{f}_{n-q}^1$$

arising from the adaptive dictionary is filtered by a filter 131 and corresponds to the excitation modelled at the lowest throughput $\hat{r}_n^1$ delayed by q samples by the aforesaid filter. The optimal waveform $f_n^1$ is delivered by the filtered adaptive dictionary 133.

A module 132 for computing and quantizing the prediction gain makes it possible, from the perceptual signal Pn and from the set of waveforms $f_n^{j(0)}$ to perform a quantization computation on the prediction gain, and to deliver an index i(0) representing the number of the quantization range, as well as its quantized associated gain g(0).

A multiplier circuit 134 delivers, from the filtered adaptive dictionary 133, that is to say from the result of filtering the waveform of index j $C_n^j$, namely $f_n^j$, and the quantized associated gain g(0), the modelled and perceptually filtered long-term prediction excitation labelled $\hat{P}_n^1$.

A subtracter circuit 135 then makes it possible to perform a minimization on $e_n=|P_n-\hat{P}_n^1|$, this expression representing the error signal. A module 136 makes it possible to compute the Euclidean norm $|e_n|^2$.

A module 137 makes it possible to search for the optimal waveform corresponding to the minimal value of the aforesaid Euclidean norm and to deliver the index j(0). The parameters transmitted by the coding system which is the subject of the present invention for modelling the long-term prediction signal are then the index j(0) of the optimal waveform $f^j(0)$ and the number i(0) of the quantization range for its quantized associated gain g(0).

A more detailed description of the adaptive orthogonal transformation module MT of FIG. 2 will be given in connection with FIGS. 4*a* and 4*b*.

In the context of the implementation of the system for predictive coding by orthonormal transform which is the subject of the present invention, the method used to construct this transform corresponds to that proposed by B. S. Atal and E. Ofer, as mentioned earlier in the description.

In accordance with the embodiment of the coding system according to the present invention, the latter consists in decomposing, not the short-term prediction filtering matrix, but the perceptual weighting matrix W formed by a lower triangular Toeplitz matrix defined by the relation (4):

$$W=\begin{bmatrix} w(0) & 0 & 0 & 0 & \dots & 0 & 0 & 0 \\ w(1) & w(0) & 0 & 0 & \dots & 0 & 0 & 0 \\ w(2) & w(1) & w(0) & 0 & \dots & 0 & 0 & 0 \\ w(3) & w(2) & w(1) & w(0) & \dots & 0 & 0 & 0 \\ \cdot & \cdot & \cdot & \cdot & & \cdot & \cdot & \cdot \\ \cdot & \cdot & \cdot & \cdot & & \cdot & \cdot & \cdot \\ \cdot & \cdot & \cdot & \cdot & & \cdot & \cdot & \cdot \\ w(N-1) & w(N-2) & w(N-3) & w(N-4) & \dots & w(2) & w(1) & w(0) \end{bmatrix}$$

In this relation, w(n) denotes the impulse response of the perceptual weighting filter W(z) of the previously mentioned current window.

Represented in FIG. 4*a* is the partial diagram of a predictive transform coder and in FIG. 4*b* the corresponding equivalent diagram in which the matrix or perceptual weighting filter W denoted 140, has been depicted, an inverse perceptual weighting filter 121 having by contrast been inserted between the long-term prediction module 13 and the subtracter circuit 120. It is indicated that the filter 140 carries out a linear combination of the basis vectors obtained from a singular-value decomposition of the matrix representing the perceptual weighting filter W.

As represented in FIG. 4*b*, the signal S' corresponding to the speech signal to be coded $S_n$ from which has been subtracted the contribution of the past excitation delivered by the module 12, as well as that of the long-term prediction $\hat{P}_n^1$ filtered by an inverse perceptual weighting module with transfer function $(W(z))^{-1}$ is filtered by the perceptual weighting filter with transfer function W(z), so as to obtain the vector P' , This filtering operation is written:

$$P'=WS'$$

and can be expressed in the form of a linear combination of basis vectors using the singular-value decomposition of the matrix W.

As regards the embodiment of the perceptual weighting filter 140, it is indicated that the latter comprises, for every matrix W representing the perceptual weighting filter, a first matrix module $U=(U_1, \dots, U_N)$ and a second matrix module $V=(V_1, \dots, V_N)$.

The first and second matrix modules satisfy the relation:

$$U^TWV=D$$

a relation in which:

$U^T$ denotes the matrix transpose module of the module U,

D is a diagonal matrix module whose coefficients constitute the said singular values, $U_i$ and $V_j$ denote respectively the $i^{th}$ left singular vector and the $j^{th}$ right singular vector, the said right singular vectors $\{V_j\}$ forming an orthonormal basis.

Such a decomposition makes it possible to replace the operation for filtering by convolution product by an operation for filtering by a linear combination.

It is indicated that the singular-value decomposition of the perceptual filtering matrix W makes it possible to obtain the two unit matrices U and V satisfying the above relation where $$U^T WV = diag(d_1, \ldots, d_N)$$

with the ordering property such that $d_i \geqq d_{i+1} > 0$. The elements $d_i$ are called the singular values, and the vectors $U_i$ and $V_j$, the ith left singular vector, respectively jth right singular vector.

The matrix W is then decomposed into a sum of matrices of rank 1, and satisfies the relation:

$$W = UDV^T = \sum_{i=1}^{N} U_i d_i V_i^T \tag{5}$$

The matrix V being unitary, the right singular vectors $\{V_i\}$ form an orthonormal basis and the signal S', expressed in the form:

$$S' = \sum_{i=1}^{N} \tilde{g}(i) V_i \quad \text{with} \quad \tilde{g}(i) = \langle S', V_i \rangle \tag{6}$$

makes it possible to obtain the vector P' satisfying the relation:

$$P' = WS' = \left( \sum_{i=1}^{N} U_i d_i V_i^T \right) \cdot \left( \sum_{k=1}^{N} \tilde{g}(k) V_k \right) = \sum_{k=1}^{N} g(k) U_k \tag{7}$$

with $g(k) = \tilde{g}(k) d_k$.

Through the process for singular-value decomposition, it is indicated that a change in one component of the excitation S' associated with a small singular value produces a small change at the output of the filter 140 and vice versa for the inverse perceptual filtering operation performed by the module 121.

So as to use these properties, the unit matrix U can be used as orthonormal transform, satisfying the relation:

$$F = [f_{orth}^1, \ldots, f_{orth}^N], \text{ that is to say:} \tag{8}$$

$$f_{orth}^1 = U_i \text{ for } i = 1 \text{ to } N.$$

The weighted perceptual signal P' is then decomposed in the manner below:

$$G = U^T P'. \tag{9}$$

After vector quantization of the gains G, the modelled weighted perceptual signal $\hat{P}$ is computed in the manner below:

$$\hat{P} = F\hat{G} = U\hat{G}. \tag{10}$$

It is indicated that the left singular vectors associated with the largest singular values play a predominant role in the modelling of the weighted perceptual signal P'. Thus, in order to model the latter, it is possible to preserve only the components associated with the K largest singular values, K<N, that is to say the first K components of the gain vector G satisfying the relation:

$$G = (g_1, g_2 \ldots g_k, 0, \ldots, 0). \tag{11}$$

The short-term analysis filtering circuit 10 being updated over windows of M samples, the singular-value decomposition of the perceptual weighting matrix W is performed at the same frequency.

Processes for the singular-value decomposition of any matrix allowing fast processing have been developed, but the computations remain relatively complex.

In accordance with a subject of the present invention, it is, so as to simplify the aforesaid processing operations, proposed to construct a fixed orthonormal transform which is sub-optimal but which however possesses good perceptual properties, whatever the current window.

In a first embodiment, such as represented in FIG. 5, the orthonormal transform process is constructed by learning. In such a case, the orthonormal transform module can be formed by a stochastic transform sub-module constructed by drawing a Gaussian random variable for initialization, this sub-module including, in FIG. 5, the process steps 1000, 1001, 1002 and 1003 and being labelled SMTS. Step 1002 can consist in applying the K-mean algorithm to the aforesaid vector corpus.

The sub-module SMTS is followed in succession by a module 1004 for constructing centres, a module 1005 for constructing classes and, in order to obtain a vector G whose components are relatively ordered, by a module 1006 for reordering the transform according to the cardinal for each class.

The aforesaid module 1006 is followed by a Gram-Schmidt computational module, labelled **1007*a*, so as to obtain an orthonormal transform. With the aforesaid module 1007*a* is associated a module 1007*b*** for computing the error under the conventional conditions for implementing the process for Gram-Schmidt processing.

Module **1007*a* is itself followed by a module 1008 for testing the number of iterations, so as to be able to obtain an orthonormal transform performed off-line by learning. Finally, the memory 1009 of read-only memory type makes it possible to store the orthonormal transform in the form of a transform vector. It is indicated that the relative ordering of the components of the gain vector G is accentuated by the orthogonalization process. When the process of construction by learning has converged, an orthonormal transform is obtained whose waveforms are gradually correlated with the learning corpus of the vectors delivered by step 1001** of initial transform.

FIGS. **5*a* and 5*b*** the ordering of the components of the gain vector G, that is to say of the normalized mean value G for a transform obtained on the one hand by singular-value decomposition of the perceptual weighting matrix W, and on the other hand, by learning. The transform F obtained by this latter method for those of the orthonormal waveforms whose frequency spectra are band-pass and relatively ordered as a function of k, thus makes it possible to attribute pseudo-frequency properties to this transform. An assessment of the quality of transformation in terms of energy concentration has made it possible to show that, by way of indication, on a corpus of 38,000 perceptual vectors P', the transformation gain is 10.35 decibels for the optimal Karhunen-Loeve transform, and 10.29 decibels for a transform constructed by learning, the latter therefore tending to the optimal transform in terms of energy concentration.

As mentioned earlier in the description, the orthonormal transform F can be obtained by two different methods.

Observing that, generally, the waveform most correlated with the perceptual signal P is that arising from the adaptive dictionary, it is possible to envisage producing an adaptive orthonormal transform F' for which $f'_{orth}{}^1$ is equal to the optimal waveform arising from the normalized adaptive dictionary $f^i(0)$, the first component of the gain vector G then being equal to the normalized long-term prediction gain g(0), which it is not necessary to recompute since it has been quantized during this prediction.

The new dimension of the gain vector G then becomes equal to N−1, thus making it possible to increase the number of binary elements per sample during vector quantization of the latter and hence the quality of its modelling.

A first solution for computing the transform F' can then consist in carrying out a long-term prediction analysis, in shifting the transform obtained by learning by one notch, in placing the long-term predictor in the first position, and then applying the Gram-Schmidt algorithm so as to obtain a new transform F'.

A second, more advantageous, solution consists in using a transformation making it possible to pivot the orthonormal basis, so that the first waveform coincides with the long-term predictor, that is to say: F'=TF
with $$f^1_{orth} = \frac{f^{(0)}}{|f^{(0)}|} = Tf^1_{orth} \tag{12}$$

With the aim of preserving the orthogonality property, the transformation used must preserve the scalar product. A particularly suitable transformation is the Householder transform satisfying the relation:

$$T = I - 2\frac{BB^T}{B^TB} \tag{13}$$

with $B=f^{j,(0)}-|f^{j(0)}|-f_{orth}{}^1$.

A geometric representation of the aforesaid transform is given in FIGS. 6*a* and 6*b*.

For a more detailed definition of this type of transformation, it will be profitable to refer to the publication by Alan O. Steinhardt entitled "Householder Transforms in Signal Processing", IEEE ASSP Magazine, July 1988, pp 4–12.

By using this transformation, it is possible to reduce the complexity of the computations and the projection of the perceptual signal P in this new basis can be written:

$$G=F'^TP=F^TTP=F^TP'' \tag{14}$$

with $P'=TP=(P-B[wB^TP])$.

In this relation, w denotes a scalar equal to $w=2/B^TB$.

It is indicated that in this embodiment of the orthonormal transform, the transformation is applied only to the perceptual signal P, and the modelled perceptual signal $\hat{P}$ can then be computed by the inverse transformation.

A particularly advantageous embodiment of the orthonormal transform module properly speaking 14 in the case where a Householder transformation is used will now be described in connection with FIG. 7.

Thus as represented in the aforesaid FIG. 7, the module 14 for adaptive transformation can include a Householder transformation module 140 receiving the estimated perceptual signal consisting of the optimal waveform and of the estimated gain and the perceptual signal P to generate a transformed perceptual signal P". It is indicated that the Householder transformation module 140 includes a module 1401 for computing the parameters B and wB such as defined earlier by relation 13. It also includes a module 1402 comprising a multiplier and a subtracter making it possible to carry out the transformation properly speaking according to relation 14. It is indicated that the transformed perceptual signal P" is delivered in the form of a transformed perceptual signal vector with component with $k \in [0,N-1]$.

The adaptive transformation module 14 such as represented in FIG. 7 also comprises a plurality N of registers for storing the orthonormal waveforms, the current register being labelled r, with $r \in [1,N]$. It is indicated that the N aforesaid storage registers form the read-only memory described earlier in the description, each register including N storage cells, each component of rank k of each vector, the component labelled $f_{orth(k)}{}^1$ being stored in a cell of corresponding rank of the current register r considered.

Furthermore, as will be observed in FIG. 7, the module 14 comprises a plurality of N multiplier circuits associated with each register of rank r forming the plurality of previously mentioned storage registers. Furthermore, each multiplier register of rank k receives on the one hand the component of rank k of the stored vector and on the other hand the component $P''_k$ of the corresponding transformed perceptual signal vector of rank k. The multiplier circuit Mrk delivers the product $P''_k \cdot f_{orth(k)}{}^k$ of the transformed perceptual signal components.

Finally, a plurality of N–1 summing circuits is associated with each register of rank r, each summing circuit of rank k, labelled Srk, receiving the product of previous rank k–1, and the product of corresponding rank k delivered by the multiplier circuit Mrk of like rank k. The summing circuit of highest rank, SrN–1 then delivers a component g(r) of the estimated gain expressed in the form of a gain vector G.

It is indicated that the predictive coding system using the adaptive orthonormal transform constructed by learning is capable of giving better results, whilst the Householder transformation makes it possible to obtain reduced complexity.

As will be observed in FIG. 2, the module for progressive modelling by orthogonal vectors in fact includes a module 15 for normalizing the gain vector to generate a normalized gain vector, labelled $G_k$, by comparing the normed value of the gain vector G with respect to a threshold value. This normalization module 15 makes it possible to generate furthermore a length signal for the normalized gain vector related to the order of modelling k destined for the decoder system as a function of this order of modelling.

The module for progressive modelling by orthogonal vectors furthermore includes, cascaded with the module 15 for normalizing the gain vector, a stage 16 for progressive modelling by orthogonal vectors. This modelling stage 16 receives from the normalized vector Gk and delivers the indices representing the coded speech signal, these indices being labelled I(1), J(1), these indices representing the selected vectors and their associated gain. Transmission of the auxiliary data formed by the indices is performed by overwriting the parts of the frame allocated to the indices and range numbers to form the auxiliary data signal.

The operation of the normalization module 15 is as follows.

The energy of the perceptual signal, given by $$|P'|^2=|G|^2$$

is constant for a given sub-window. Under these conditions, maximizing this energy is equivalent to minimizing the expression:

$$|P' - F'^TG_K|^2 = \sum_{i=K+1}^{N} g_i^2 = |P'|^2 - \sum_{i=2}^{K} g_i^2 \tag{15}$$

where $G_k=(0,g_2,g_3, \ldots ,g_k, 0, \ldots 0)$.

It is indicated that, during such an operation, a further way of increasing the number of binary elements per sample during vector quantization of the vector G is to use the following normalized criterion, consisting in choosing K such that:

$$\frac{\sum_{k=2}^{K} g_k^2}{\|P'\|} \geqq s \quad \text{with } 0 \leqq s \leqq 1 \tag{16}$$

The gain vector thus obtained $G_k$ is then quantized and its length k is transmitted by the coding system which is the subject of the present invention so as to be taken into account by the corresponding decoding system, as will be described later in the description.

The mean normalized criterion dependent on the order of modelling K is given in FIG. 8*a* for an orthonormal transform obtained on the one hand by singular-value decomposition of the perceptual weighting matrix W and on the other hand by learning.

A particularly advantageous embodiment of the module for progressive modelling by orthogonal vectors 16 will now be given in connection with FIG. 8*b*. The aforesaid module makes it possible in fact to produce a multistage vector quantization.

The gain vector $\hat{G}$ is obtained by linear combination of vectors, written $$\Psi_k^j=(0, \Psi_2^j, \Psi_3^j, \ldots, \Psi_k^j 0,0 \ldots 0). \tag{17}$$

These vectors arising from stochastic dictionaries, labelled 161, 162, 16 L, constructed either by drawing a Gaussian random variable, or by learning. The estimated gain vector G satisfies the relation:

$$\hat{G}=\sum_{i=1}^{L} \theta_1 \Psi_k^{j(1)}$$

In this relation, $\theta_1$ is the gain associated with the optimal vector $\Psi_k^{j(1)}$ arising from the stochastic dictionary of rank 1, labelled 16 l.

However, the iteratively selected vectors are not generally linearly independent and do not therefore form a basis. In such cases, the subspace generated by the L optimal vectors $\Psi_k^{j(L)}$ is of dimension less than L.

Represented in FIG. 9 is the projection of the vector G onto the subspace generated by the optimal vectors of rank l, respectively l−1, this projection being optimal when the aforesaid vectors are orthogonal.

It is therefore particularly advantageous to orthogonalize the stochastic dictionary of rank 1 with respect to the optimal vector of the stage of preceding rank $\Psi_k^{j(L-1)}$.

Thus, whatever the optimal vector of rank l arising from the new dictionary or stage of corresponding rank 1, the latter will be orthogonal to the optimal vector $\Psi_k^{j(l-1)}$ of previous rank, and we obtain:

$$\Psi_{orth(l+1)}^j=\Psi_{orth(l)}^j-r(1,j)\frac{\Psi_{orth(l)}^{j(l)}}{\gamma\alpha_l^{j(l)}} \tag{18}$$

In this relation, it is indicated that:

$$\alpha_l^{j(1)}=|\Psi_{orth(l)}^{j(1)}|^2 \tag{19}$$

corresponds to the energy of the wave selected in step 1, $$r(l,j)=<\frac{\Psi_{orth(l)}^{j(l)}}{\gamma\alpha_l^{j(l)}}, \Psi_{orth(l)}^j> \tag{20}$$

represents the cross-correlation of the optimal vectors of rank j and of rank j (l) and $$T_K=I_N-\frac{\Psi_{orth(l)}^{j(l)}}{\gamma\alpha_l^{j(l)}}(\Psi_{orth(l)}^j)^T \tag{21}$$

represents the orthogonalization matrix.

The preceding operation makes it possible to remove from the dictionary the contribution of the previously selected wave and thus imposes linear independence for every optimal vector of rank i included between l+1 and L with respect to the optimal vectors of lower rank.

Basic diagrams of vector quantization by progressive orthogonal modelling are given in FIGS. 10*a* and 10*b* depending on whether there are one or more stochastic dictionaries.

In order to reduce the complexity of the vector quantization process, it is indicated that the recursive modified Gram-Schmidt algorithm can be used as proposed by N. Moreau, P. Dymarski, A. Vigier, in the publication entitled: "Optimal and Suboptimal Algorithms for Selecting the Excitation in Linear Predictive Products", Proc. ICASSP 90, pp 485–488.

Bearing in mind the orthogonalization properties, it can be shown that:

$$r(l,j)=\frac{1}{\gamma\alpha_l^{j(l)}}\left[<\Psi^{j(l)}, \Psi^j>-\sum_{i=1}^{l-1} r(i,j(l)r(i,j)\right] \tag{22}$$

Bearing in mind this expression, the recursive modified Gram-Schmidt algorithm as proposed earlier can be used.

It is then no longer necessary to recompute the dictionaries explicitly at each step of the orthogonalization.

The aforesaid computational process can be explained in matrix form based on the matrix $$A=[\Psi_K^{j(l)}, \ldots, \Psi_K^{j(l)}] \tag{23}$$

$$A=QR=[\Psi_{orth(l)}^{j(l)} \ldots \Psi_{orth(L)}^{j(l)}] \tag{24}$$

$$\begin{bmatrix} 1 & \frac{r(l,j(2))}{\gamma\alpha_1^{j(l)}} & \ldots & \frac{r(l,j(t-1))}{\gamma\alpha_1^{j(l)}} & \frac{r(i,j(L))}{\gamma\alpha_1^{j(l)}} \\ 0 & 1 & \ldots & . & \frac{r(2,i(L))}{\gamma\alpha_2^{j(2)}} \\ . & . & \ldots & . & . \\ 0 & . & \ldots & 1 & \frac{r(L-1,j(L))}{\gamma\alpha_{L-1}^{j(L-1)}} \\ 0 & . & \ldots & 0 & 1 \end{bmatrix}$$

It is indicated that Q is an orthonormal matrix, and R an upper triangular matrix, the elements of the main diagonal of which are all positive, thus ensuring the uniqueness of the decomposition.

The gain vector G satisfies the matrix relation:

$$G=Q\tilde{\theta}=A\theta=QR\theta \tag{25}$$

which implies that $R\theta=\tilde{\theta}$.

The upper triangular matrix R thus enables the gains $\theta(k)$ relating to the original basis to be computed recursively.

The contribution of the optimal vectors to the orthonormal basis, written: $\{\Psi_{orth(L)}^{j(1)}\}$ in the modelling of the gain vector $G_k$ tends to decrease, and the gains $\{\theta_1\}$ are ordered decreasingly. The residual can be modelled in a gradual manner in the manner below where $\hat{\theta}_k^{cod}$ denotes the gain associated with the quantized orthogonal optimal vector $\Psi_{orth(k)}^{j(k)}$, bearing in mind the relations:

$$\hat{G}^1=\sum_{i=1}^{L_1-1} \tilde{\theta}_1^{cod} \Psi_{orth(l)}^{j(l)}$$

$$\hat{G}^2=\sum_{l=L_1}^{L_2-1} \tilde{\theta}_1^{cod} \Psi_{orth(l)}^{j(l)}$$

$$\hat{G}^3=\sum_{l=L_2}^{L} \tilde{\theta}_1^{rod} \Psi_{orth(l)}^{j(l)}$$

$$\hat{G}=\hat{G}^1+\hat{G}^2+\hat{G}^3 \quad \text{(highest throughput)}$$

$$\hat{G}=\hat{G}^1+\hat{G}^2 \quad \text{(intermediate throughput)}$$

$$\hat{G}=\hat{G}^1 \quad \text{(lowest throughput)}$$

with $1 \leqq L_1 \leqq L_2 \leqq L$.

The orthogonal gain vectors $\hat{G}^1$, $\hat{G}^2$, $\hat{G}^3$ are then obtained, the contribution of which in the modelling of the gain vector G is decreasing, thus allowing gradual modelling of the residual $r_n$ in an efficient manner. The parameters transmitted by the coding system which is the subject of the present invention for modelling the gain vector G are then the indices j(l) of the selected vectors as well as the numbers i(l) of the quantization ranges for their associated gains $\theta_1$. Transmission of the data is then carried out by overwriting the parts of the frame allocated to the indices and range numbers j(l), i(l), for l $\epsilon$[L1,L2−1] and [L2,L] depending on the needs of the communication.

The previously mentioned processing uses the recursive modified Gram-Schmidt algorithm to code the gain vector G. The parameters transmitted by the coding system according to the invention being the aforesaid indices j(0) to j(L) of the various dictionaries as well as the quantized gains g(0) and $\{\theta_k\}$, it is necessary to code the various aforesaid gains g(0) and $\{\theta_k\}$. Research shows that the gains relating to the orthogonal base $\{\Psi_{orth(L)}^{j(l)}\}$ being uncorrelated, the latter possess good properties in respect of their quantization. Furthermore, the contribution of the optimal vectors to the modelling of the gain vectors G tending to decrease, the gains $\{\theta_1\}$ 30 are ordered in relatively decreasing fashion, and it is possible to use this property by coding not the aforesaid gains, but their ratio given by $\theta_l/\theta_{l-1}$. Several solutions may be used to code the aforesaid ratios.

Thus, as will be observed in FIG. 2, the coding device which is the subject of the present invention includes a module for modelling the excitation of the synthesis filter corresponding to the lowest throughput, this module being labelled 17 in the aforesaid figure.

The basic diagram for computing the excitation signal of the synthesis filter corresponding to the lowest throughput is shown in FIG. 11. An inverse transformation is applied to the modelled gain vectors $\hat{G}^1$, this inverse adaptive transformation possibly for example corresponding to an inverse transformation of Householder type, which will be described later in the description, in connection with the decoding device which is the subject of the present invention. The signal obtained after inverse adaptive transformation is added to the long-term prediction signal $B'_n{}^1$ by means of a summing unit 171, the estimated perceptual signal or long-term prediction signal being delivered by the closed-loop long-term prediction circuit 13. The resultant signal delivered by the summing unit 171 is filtered by a filter 172, which, from the point of view of the transfer function, corresponds to the filter 131 of FIG. 3. The filter 172 delivers the modelled residual signal $\hat{r}_n{}^1$.

A system for predictive decoding by embedded-code adaptive transform of a coded digital signal consisting of a coded speech signal, and if appropriate, of an auxiliary data signal inserted into the coded speech signal after coding the latter will now be described in connection with FIG. 12.

According to the aforesaid figure the decoding system comprises a circuit 20 for extracting the data signal making it possible, on the one hand, to extract the data with a view to an auxiliary use, via an auxiliary data output and, on the other hand, to transmit indices representing the coded speech signal. It is of course understood that the aforesaid indices are the indices i(l) and j(l), for l between 0 and $L_1-1$ described earlier in the description and for l between $l_1$ and L under the conditions which will be described later. Thus, as has furthermore been represented in FIG. 12, the decoding system according to the invention comprises a circuit 21 for modelling the speech signal at the minimum throughput, as well as a circuit 22 or 23 for modelling the speech signal at at least one throughput above the aforesaid minimum throughput.

In a preferred embodiment, such as represented in FIG. 12, the decoding system according to the invention includes, apart from the data extraction system 20, a first module 21 for modelling the speech signal at the minimum throughput receiving the coded signal directly and delivering a first estimated speech signal, labelled $\hat{S}_n{}^1$ and a second module 22 for modelling the speech signal at an intermediate throughput connected with the data extraction system 20 by way of a circuit 27 for conditional switching by criterion of the actual throughput allocated to the speech signal and delivering a second estimated speech signal, labelled $\hat{S}_n{}^2$.

The decoding system represented in FIG. 12 also includes a third module 23 for modelling the speech signal at a maximum throughput, this module being connected to the data extraction system 20 by way of a circuit 28 for conditional switching by criterion of the actual throughput allocated to the speech and delivering a third estimated speech signal $\hat{S}_n{}^3$.

Furthermore, a summing circuit 24 receives the first, second and third estimated speech signals, and delivers at its output a resultant estimated speech signal, labelled $\hat{S}_n$. At the output of the summing circuit 24 are cascaded an adaptive filtering circuit 25 receiving the resultant estimated speech signal $\hat{S}_n$ and delivering a reproduced estimated speech signal, labelled $\hat{S}'_n$. A digital/analog converter 26 can be provided in order to receive the reproduced speech signal and deliver an audio frequency reproduced speech signal.

According to a particularly advantageous characteristic of the decoding device which is the subject of the present invention, each of the minimum, intermediate and maximum throughput speech signal modelling modules, that is to say modules 21, 22 and 23 of FIG. 12, comprises an inverse adaptive transformation sub-module followed by an inverse perceptual weighting filter.

The basic diagram of the minimum throughput speech signal modelling module is given in FIG. 13*a*.

Generally, the decoding system which is the subject of the present invention takes into account the constraints imposed by the transmission of data at the level of the coding system and in particular at the level of the adaptive dictionary, as well as the contribution of the past excitation.

The minimum throughput speech signal modelling circuit 21 is identical to that described in relation to the circuit 17 of the coding system according to the invention starting from an inverse adaptive transformation module similar to the module 170 described in connection with FIG. 11. It is noted simply that in FIG. 13*a*, the obtaining of the perceptual signal $\hat{P}_n{}^1$ from the indices {i(0), j(0)}, from the order of modelling K and from the indices i(l), j(l) for l=1 to L1−1 has been explained.

As regards the inverse adaptive transformation, an advantageous embodiment thereof is represented in FIG. 13*b*. It is indicated that the embodiment represented in FIG. 13*b* corresponds to a transform of inverse Householder type using elements identical to the Householder transform represented in FIG. 7. It is indicated simply that for a perceptual signal delivered by the long-term prediction circuit 13, this signal being labelled $\hat{P}^1$, entering a similar module 140, the signals entering the module 1402, at the level of the multipliers associated with each register respectively, are inverted. The resultant signal delivered by the summing unit corresponding to the summing unit 171 of FIG. 11 is filtered by a filter with transfer function inverse to the transfer function of the perceptual weighting matrix and corresponding to the filter 172 of the same FIG. 11.

The modules for modelling the speech signal at the intermediate throughput or at the maximum throughput, module 22 or 23, are represented in FIGS. 14*a* and 14*b*.

Of course, it is possible for reasons of complexity to group the various modellings of the speech signal corresponding to the other throughputs into a single block such as represented in FIG. 14*a* and 14*b*. Depending on the actual throughput allocated to the speech, the modelled gain vectors $\hat{G}^2$, $\hat{G}^3$, are added up, as represented in FIG. 14*b*, by a summing unit 220, are subjected to the inverse adaptive transformation process in a module 221 identical to the module 210 of FIG. 13*a*, and are then filtered by the inverse weighting filter $W^{-1}(z)$ mentioned earlier, this filter being denoted by 222, the filtering starting from zero initial conditions, thus making it possible to perform an operation equivalent to multiplication by the inverse matrix $W^{-1}$, so as to obtain progressive modelling of the synthesis signal $\hat{S}_n$. In FIG. 14*b* the presence is noted of switching devices, which are none other than the switching devices 24 and 28 represented in FIG. 12, they being controlled as a function of the actual throughput of the transmitted data.

Finally, as regards the adaptive filter 25, a particularly advantageous embodiment is given in FIG. 15. This adaptive filter makes it possible to improve the perceptual quality of the synthesis signal $\hat{S}_n$ obtained following the summation by the summing unit 24. Such a filter comprises for example a long-term postfiltering module labelled 250, followed by a short-term post-filtering module and by a module 252 for monitoring the energy, and which is driven by a module 253 for computing the scale factor. Thus, the adaptive filter 25 delivers the filtered signal $\hat{S}'_n$, this signal corresponding to the signal in which the quantization noise introduced by the coder into the synthesized speech signal has been filtered in the zones of the spectrum where this is possible. It is indicated that the diagram represented in FIG. 15 corresponds to the publications by J. H. Chen and A. Gersho, "Real Time Vector APC Speech Coding at 4800 Bps with Adaptive Postfiltering", ICASSP 87, Vol. 3, pp 2185–2188.

There has thus been described a system for predictive coding by embedded-code orthonormal transform making it possible to afford unpublished solutions within the field of embedded-code coders. It is indicated that, generally, the coding system which is the subject of the present invention allows wide band coding at speech/data throughputs of 32/0 kbit/s, 24/8 kbit/s and 16/16 kbit/s.

I claim:

1. System for predictive coding of a digital signal as an embedded-code digital signal, coded by embedded-code adaptive transformation, in which the coded digital signal comprises a coded speech signal and, if appropriate, an auxiliary data signal inserted into the coded speech signal after coding said digital speech signal, said system comprising:

a perceptual weighting filter driven by a short-term prediction loop delivering a perceptual signal; $\ddot{P}_n$.;

a long-term prediction circuit delivering an estimated perceptual signal $\hat{P}^1_n$, said long-term prediction circuit forming a long-term prediction loop delivering, from said perceptual signal and from an estimated past excitation signal $\hat{P}^O_n$, a modelled perceptual excitation signal $\hat{P}_n$;

adaptive transform and quantization means for receiving said modelled perceptual excitation signal, and for generating said coded speech signal, said perceptual weighting filter including a filter, driven by a short-term prediction loop for providing short-term prediction of a speech signal to be coded, for producing a frequency distribution of quantization noise; and means for subtracting said past excitation signal $\hat{P}^0_n$, from said perceptual signal to deliver an updated modelled perceptual signal $P_n$, said long-term prediction circuit being formed, as a closed loop, from a dictionary updated by a modelled past excitation corresponding to the lowest throughput and delivering a waveform, and an estimated gain associated therewith, which make up the estimated perceptual signal, said adaptive transform and quantization means including an orthonormal transform module including an adaptive orthogonal transformation module and a module for progressive modelling by orthogonal vectors, said means of progressive modelling and said long-term prediction circuit making it possible to deliver indices representing the coded speech signal, said system further including means for inserting auxiliary data, coupled to a transmission channel.

2. Coding system according to claim 1, wherein said adaptive orthogonal transformation module includes:

means for subtracting said estimated past excitation signal from a speech signal to be coded and for delivering a reduced speech signal;

means for inverse perceptual weighting filtering said estimated perceptual signal and delivering a filtered estimated perceptual signal;

means for subtracting said filtered estimated perceptual signal from said reduced speech signal and delivering an excitation signal; and a perceptual weighting filter receiving said excitation signal and delivering a linear combination of basis vectors obtained from a singular-value decomposition of a matrix representing said perceptual weighting filter.

3. Coding system according to claim 2, wherein said filter comprises, for every matrix W representing the perceptual weighting filter:

a first matrix module $U=(U_1, \ldots, U_N)$; and a second matrix module $V=(V_1, \ldots, V_N)$, said first and second matrix modules satisfying the relation:

$$U^T WV = D$$

where $U^T$ denotes the matrix transpose module of the module U and

D is a diagonal matrix module whose coefficients constitute said singular values, $U_i$ and $V_j$ denoting respectively the $i^{th}$ left singular vector and the $j^{th}$ right singular vector, said right singular vectors $\{V_j\}$ forming an orthonormal basis, thus making it possible to transform the operation for filtering by convolution product by an operation for filtering by a linear combination.

4. Coding system according to claim 1, wherein said orthonormal transform module comprises:

a stochastic transform sub-module constructed by drawing a Gaussian random variable, for initialization;

a module for global averaging over a plurality of vectors arising from a predictive transform coder;

a reordering module;

a Gram-Schmidt processing module for obtaining, after one reiteration of the processing by the preceding modules an orthonormal transform, performed off-line, formed by learning; and a read-only memory storing said orthonormal transform in the form of transformed vectors.

5. Coding system according to claim 4, characterized in that the said transform is formed by orthonormal waveforms whose frequency spectra are band-pass and relatively ordered, the first waveform of relatively ordered orthonormal waveforms being equal to the normalized optimal waveform arising from the said adaptive dictionary and the first component of estimated gain is equal to the normalized long-term prediction gain.

6. Coding system according to claim 5, wherein said adaptive transformation module includes:

a Householder transformation module receiving said estimated perceptual signal $\hat{P}^1_l$ consisting of said optimal waveform and of said estimated gain, and said perceptual signal, and generating a transformed perceptual signal P" in the form of a transformed perceptual signal vector with component $P''_k$ a plurality of N registers for storing said orthonormal waveforms, said plurality of registers forming said read-only memory, each register of rank r including N storage cells, a component of rank k of each vector being stored in a cell of corresponding rank;

a plurality of N multiplier circuits associated with each register forming said plurality of storage registers, each multiplier circuit of rank k receiving, on the one hand, the component of rank k of the stored vector and, on the other hand, the component P"k of the transformed perceptual signal vector of rank k, and delivering the product $P''_k \cdot f^k_{orhth}(k)$ of said transformed perceptual signal vector components; and a plurality of N–1 summing circuits associated with each register of rank r, each summing circuit of rank k receiving the product of previous rank k–1 delivered by the multiplier circuit of previous rank and the product of corresponding rank k delivered by the multiplier circuit of previous rank and the product of corresponding rank k delivered by the multiplier circuit of like rank k, the summing circuit of highest rank, N–1, delivering a component g(r) of the estimated gain, expressed as gain vector G.

7. System according to claim 1, wherein said module for progressive modelling by orthogonal vector includes:

a module for normalizing the gain vector to generate a normalized gain vector Gk, by comparing the normed value of gain vector G with a threshold value, said normalization module delivering a length signal for said normalized gain vector Gk, destined for a decoder system as a function of the order of modelling; and a stage for progressive modelling by orthogonal vectors receiving said normalized vector Gk and delivering said indices representing the coded speech signal, said indices being representative of the selected vectors and of their associated gains, transmission of the auxiliary data formed by the indices being performed by overwriting the parts of the frame allocated to said indices and range numbers to form the auxiliary data signal.

8. A system according to claim 1, wherein said indices representing the coded speech signal delivered by said means of progressive modelling and said long-term prediction circuit comprise parameters data modelling an estimated gain $\hat{G}$, said estimated gain verifying the relation:

$$\hat{G} = \sum_{i=1}^{L} \theta_1 \psi_k^{j(1)}$$

in which $\Psi_k^{j(1)}$ designates an optimal vector drawn from a stochastic dictionary of corresponding rank l with 1 $\epsilon$[1,L], and $\theta_1$ designates the gain value associated to said optimal vector;

said parameters data including indices j(1) of the selected optimal vectors as well as number i(1) of the quantization ranges of their associated gain values, and transmission of said parameters data being carried out by overwriting the parts of a frame allocate to said indices and range numbers for 1 $\epsilon[L_1, L_2-1]$ and $[L_2, L]$, respectively, wherein $L_1$ and $L_2$ designate intermediate values between 1 and L, with $1 \leqq L_1 \leqq L_2 \leqq L$.

9. A system for predictive decoding by adaptive transform for a digital signal coded with embedded code in which the coded digital signal comprises a coded speech signal and, if appropriate, of an auxiliary data signal inserted into the coded speech signal after coding the latter, said coded speech signal being represented by parameters data modelling an estimated gain $\hat{G}$, said estimated gain verifying the relation:

$$\hat{G} = \sum_{i=1}^{L} \theta_1 \psi_k^{j(1)}$$

in which $\Psi_k^{j(1)}$ designates an optimal vector drawn from a stochastic dictionary of corresponding rank 1 with 1 $\epsilon$[1,L], and $\theta_1$ designates the gain value associated to said optimal vector;

said parameters data including indices j(1) of the selected optimal vectors as well as number i(1) of the quantization ranges of their associated gain values, said indices comprising received indices received through a transmission carried out by overwriting the parts of a frame allocated to said indices and range numbers for $1\epsilon[L_1, L_2-1]$ and $[L_2, L]$, respectively, wherein $L_1$ and $L_2$ designate intermediate values between 1 and L, with $1 \leqq L_1 \leqq L_2 \leqq L$, said system comprising:

means for extracting auxiliary data from said data signal for an auxiliary use and for transmitting said received indices representing said coded speech signal to a modelling means; said modelling means comprising means for modelling the speech signal from said received indices at a minimum throughput and for modelling the speech signal from said received indices at at least one throughput above said minimum throughput.

10. Decoding system according to claim 9, wherein said modelling means comprises a first module for modelling the speech signal at the minimum throughput, receiving said coded signal directly and delivering a first estimated speech signal $\hat{S}^1_n$;

a second module for modelling said speech signal at an intermediate throughput connected with said extracting means by means for conditional switching by criterion of the value of said indices, and delivering a second estimated speech signal $\hat{S}^2_n$; and a third module for modelling said speech signal at maximum throughput, connected with said extracting means by means for conditional switching by criterion of particular value of said indices and delivering a third estimated speech signal $\hat{S}^3_n$, said decoding system further comprising:

a summing circuit receiving said first, said second and said third estimated speech signals and delivering a resultant estimated speech signal;

an adaptive filtering circuit receiving said resultant estimated speech signal and delivering a reproduced estimated speech signal and a digital/analog converter receiving said reproduced estimated speech signal and delivering an audio frequency reproduced speech signal.

11. Decoding system according to claim 10, wherein said each of first, second and third modules comprise an inverse adaptive transformation sub-module followed by an inverse perceptual weighting filter.

* * * * *